US011116372B2

(12) United States Patent
Tran

(10) Patent No.: US 11,116,372 B2
(45) **Date of Patent: *Sep. 14, 2021**

(54) VACUUM CLEANER

(71) Applicant: BISSELL Homecare, Inc., Grand Rapids, MI (US)

(72) Inventor: Phong H. Tran, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 376 days.

This patent is subject to a terminal disclaimer.

(21) Appl. No.: 16/233,583

(22) Filed: Dec. 27, 2018

(65) Prior Publication Data

US 2019/0125151 A1 May 2, 2019

Related U.S. Application Data

(63) Continuation of application No. 15/144,213, filed on May 2, 2016, now Pat. No. 10,182,692, which is a (Continued)

(51) Int. Cl.

| | |
|---|---|
| ***A47L 9/16*** | (2006.01) |
| ***A47L 5/36*** | (2006.01) |
| ***A47L 9/20*** | (2006.01) |
| ***A47L 9/04*** | (2006.01) |
| ***A47L 9/32*** | (2006.01) |

(52) U.S. Cl.

CPC ..... *A47L 9/1608* (2013.01); *A47L 5/365* (2013.01); *A47L 9/0477* (2013.01); *A47L 9/1633* (2013.01); *A47L 9/1666* (2013.01); *A47L 9/1683* (2013.01); *A47L 9/20* (2013.01); *A47L 9/325* (2013.01); *Y10S 55/03* (2013.01)

(58) Field of Classification Search

CPC .... A47L 9/1608; A47L 9/0477; A47L 9/1633; A47L 9/20; A47L 5/365; A47L 9/1683; A47L 9/1666; A47L 9/325; Y10S 55/03; B04C 5/185

See application file for complete search history.

(56) References Cited

U.S. PATENT DOCUMENTS

| | | | |
|---|---|---|---|
| 2,071,975 | A | 2/1937 | Holm-Hansen et al. |
| 2,171,248 | A | 8/1939 | Van Berkel |

(Continued)

FOREIGN PATENT DOCUMENTS

| | | | |
|---|---|---|---|
| CA | 2593950 | A1 | 6/2008 |
| CA | 2675714 | A1 | 6/2008 |

(Continued)

OTHER PUBLICATIONS

Protest Against Canadian Patent Application No. 2,919,941 by Submission of Prior Art under Section 34.1 of the Patent Act, filed Apr. 25, 2016, 186 pages, Canada.

*Primary Examiner* — David Redding
(74) *Attorney, Agent, or Firm* — McGarry Bair PC

(57) ABSTRACT

A vacuum cleaner includes a cyclone separator, a collection chamber below the cyclone separator, a pre-motor filter downstream from the cyclone separator, and an openable cover above the pre-motor filter. The cover provides access to an upstream surface of the pre-motor filter when open, and forms an outer surface of the vacuum cleaner that is angled forwardly at an incline.

20 Claims, 17 Drawing Sheets

Related U.S. Application Data continuation of application No. 14/644,761, filed on Mar. 11, 2015, now Pat. No. 9,775,482, which is a continuation of application No. 14/030,074, filed on Sep. 18, 2013, now Pat. No. 9,009,914.

(60) Provisional application No. 61/705,803, filed on Sep. 26, 2012.

(56) References Cited

U.S. PATENT DOCUMENTS

| | | | |
|---|---|---|---|
| 2,392,872 | A | 1/1946 | Wolfe |
| 3,870,486 | A | 3/1975 | Eriksson et al. |
| 3,877,902 | A | 4/1975 | Eriksson et al. |
| 5,504,970 | A | 4/1996 | Neshat et al. |
| 6,003,196 | A | 12/1999 | Wright et al. |
| 6,521,006 | B2 | 2/2003 | Park et al. |
| 6,625,845 | B2 | 9/2003 | Hayashi et al. |
| 6,648,934 | B2 | 11/2003 | Choi et al. |
| 6,660,053 | B2 | 12/2003 | Oh et al. |
| 6,948,212 | B2 | 9/2005 | Oh et al. |
| 7,105,035 | B2 | 9/2006 | Oh et al. |
| 7,260,867 | B2 | 8/2007 | Overvaag |
| 7,544,224 | B2 | 6/2009 | Tanner et al. |
| 7,559,963 | B2 | 7/2009 | Oh et al. |
| 7,931,722 | B2 | 4/2011 | Sepke et al. |
| 3,069,529 | A1 | 12/2011 | Groff et al. |
| 8,146,201 | B2 | 4/2012 | Conrad |
| 8,163,051 | B2 | 4/2012 | Yun et al. |
| 8,769,764 | B2 | 7/2014 | Crouch et al. |
| 10,182,692 | B2 * | 1/2019 | Tran ..... A47L 9/1633 |
| 2004/0163207 | A1 | 8/2004 | Oh |
| 2007/0175185 | A1 | 8/2007 | Kim et al. |
| 2008/0172823 | A1 | 7/2008 | Yoo et al. |
| 2008/0196194 | A1 | 8/2008 | Conrad |
| 2009/0305862 | A1 | 12/2009 | Yoo |
| 2011/0225766 | A1 | 9/2011 | Xue |
| 2012/0030896 | A1 | 2/2012 | Crouch et al. |

FOREIGN PATENT DOCUMENTS

| | | | |
|---|---|---|---|
| CA | 2883018 | A1 | 6/2008 |
| CA | 2919941 | A1 | 2/2014 |
| EP | 1323370 | A2 | 7/2003 |
| EP | 1438918 | A1 | 7/2004 |
| EP | 2581009 | A1 | 4/2013 |
| GB | 2108377 | A | 5/1983 |
| GB | 2428559 | A | 7/2007 |
| GB | 2435818 | A | 12/2007 |
| JP | 2011250971 | A | 12/2011 |
| JP | 2012070973 | A | 4/2012 |
| WO | 2006026414 | A2 | 3/2006 |
| WO | 20080136575 | A1 | 11/2008 |
| WO | 2010016672 | A2 | 2/2010 |

* cited by examiner

VACUUM CLEANER

CROSS-REFERENCE TO RELATED APPLICATION(S)

This application is a continuation of U.S. patent application Ser. No. 15/144,213, filed May 2, 2016, now U.S. Pat. No. 10,182,692, issued Jan. 22, 2019, which is a continuation of U.S. patent application Ser. No. 14/644,761, filed Mar. 11, 2015, now U.S. Pat. No. 9,775,482, issued Oct. 3, 2017, which is a continuation of U.S. patent application Ser. No. 14/030,074, filed Sep. 18, 2013, now U.S. Pat. No. 9,009,914, issued Apr. 21, 2015, which claims the benefit of U.S. Provisional Patent Application No. 61/705,803, filed Sep. 26, 2012, all of which are incorporated herein by reference in their entirety.

BACKGROUND

Upright vacuum cleaners employ a variety of dirt separators to remove dirt and debris from a working air stream. Some dirt separators use one or more frusto-conical-shaped separator(s) and others use high-speed rotational motion of the air/dirt to separate the dirt by centrifugal force. Typically, working air enters and exits at an upper portion of the dirt separator as the bottom portion of the dirt separator is used to collect debris. Before exiting the dirt separator, the working air may flow through an exhaust grill. The exhaust grill can have perforations, holes, vanes, or louvers defining openings through which air may pass.

A dirt collector can be provided for collecting the removed dirt from the working air stream, and can be separate or integral with the dirt separator. In vacuum cleaners where the dirt separator and collector are integral, the entire separator/collector assembly can be removable from the vacuum cleaner for emptying collected dirt. In some cases, a bottom wall of the dirt collector serves as a dirt door, and is provided with a release mechanism for opening the dirt door to empty the accumulated contents.

BRIEF SUMMARY

According to one aspect of the present disclosure, a vacuum cleaner includes a suction inlet for working air, a cyclone separator having an air inlet for the working air in fluid communication with the suction inlet, and an air outlet for the working air at an upper end thereof, a collection chamber below the cyclone separator and having a side wall, a pre-motor filter downstream from the cyclone separator and above the upper end thereof, the pre-motor filter positioned in a pre-motor filter housing and comprising an upstream surface and a downstream surface, wherein the upstream surface is the first portion of the pre-motor filter exposed to the working air during operation of the vacuum cleaner, a door pivotally mounted to the side wall of the collection chamber by a hinge and forming a bottom wall of the collection chamber when closed, a first latch opposite the hinge and selectively maintaining the door in the closed position, an openable cover above the pre-motor filter and having an upper surface that forms an outer surface of the vacuum cleaner and having a bottom edge, wherein the cover provides access to the upstream surface of the pre-motor filter when open, a second latch on the openable cover to secure the cover in place, a suction source positioned downstream of the pre-motor filter, and an exhaust outlet for the working air downstream of the suction source, wherein the upper surface of the cover is angled forwardly at an incline, with a forwardmost portion of the cover being lower than a rearmost portion of the cover.

DETAILED DESCRIPTION

The present disclosure relates to vacuum cleaners and in particular to vacuum cleaners having dirt separation and collection assemblies. For purposes of description related to the figures, the terms "upper," "lower," "right," "left," "rear," "front," "vertical," "horizontal," and derivatives thereof shall relate to the aspects of the present disclosure as oriented in FIG. 1 from the perspective of a user behind the vacuum cleaner, which defines the rear of the vacuum cleaner. However, it is to be understood that the aspects of the present disclosure may assume various alternative orientations, except where expressly specified to the contrary.

Figure 1:
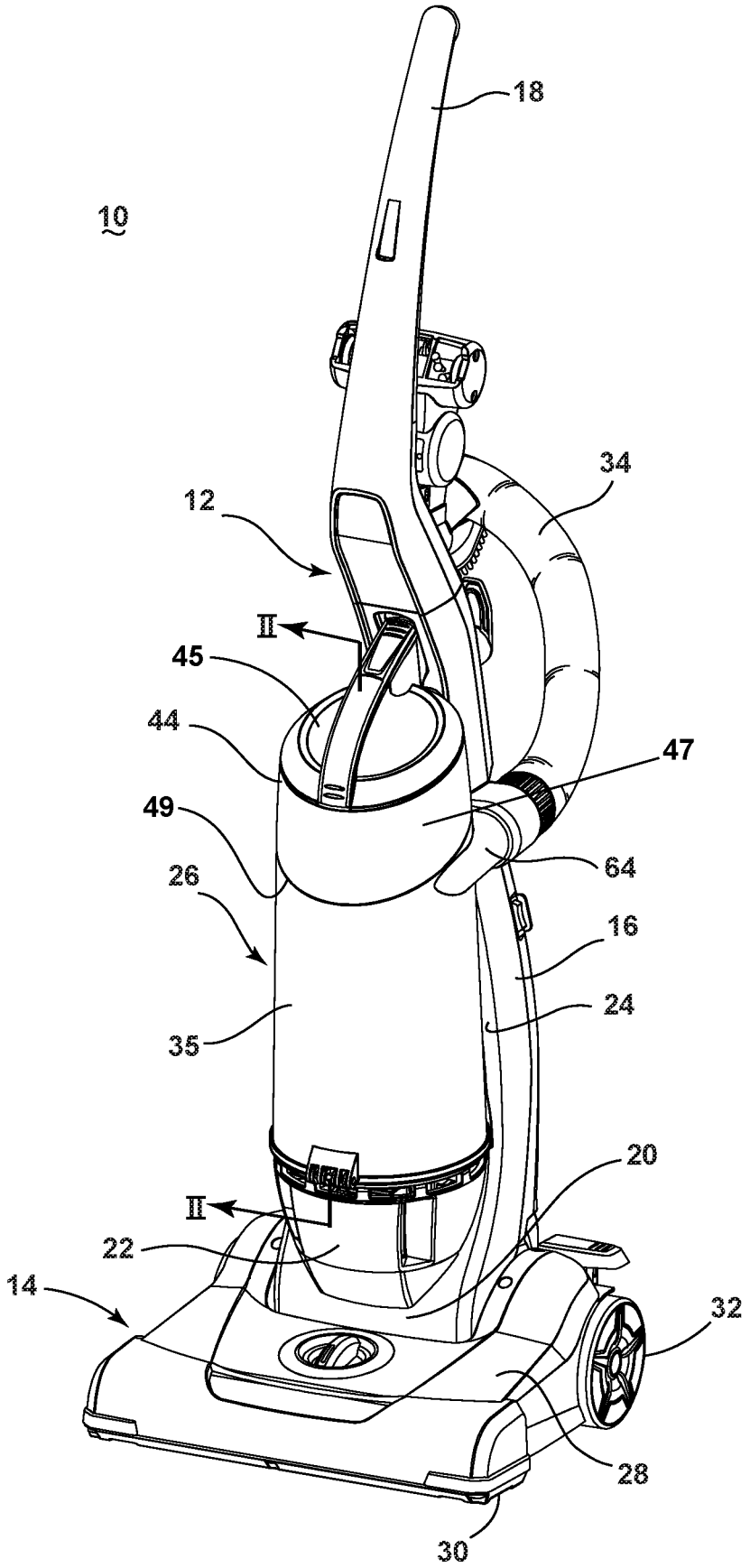
FIG. 1 is a perspective view of a vacuum cleaner according to a first aspect of the present disclosure.

Referring to the drawings, and in particular to FIG. 1, an upright vacuum cleaner 10 according to a first aspect of the present disclosure comprises an upright handle assembly 12 pivotally mounted to a foot assembly 14. The handle assembly 12 further comprises a primary support section 16 with a grip 18 on one end to facilitate movement by a user. A motor cavity 20 is formed at an opposite end of the handle assembly 12 to contain a conventional suction source such as a vacuum fan/motor assembly (not shown) oriented transversely therein. The handle assembly 12 pivots relative to the foot assembly 14 through a pivot axis that is coaxial with a motor shaft (not shown) associated with the vacuum fan/motor assembly. A post-motor filter housing 22 is formed above the motor cavity 20 and is in fluid communication with the vacuum fan/motor assembly, and receives a filter media (not shown) for filtering air exhausted from the vacuum fan/motor assembly before the air exits the vacuum cleaner 10. A mounting section 24 on the primary support section 16 of the handle assembly 12 receives a separation/collection module 26 for separating dirt and other contaminants from a dirt-containing working airstream.

The foot assembly 14 comprises a housing 28 with a suction nozzle 30 formed at a lower surface thereof and that is in fluid communication with the vacuum fan/motor assembly. While not shown, an agitator can be positioned within the housing 28 adjacent the suction nozzle 30 and operably connected to a dedicated agitator motor, or to the vacuum fan/motor assembly within the motor cavity 20 via a stretch belt. Rear wheels 32 are secured to a rearward portion of the foot assembly 14 and front wheels (not shown) are secured to a forward portion of the foot assembly 14 for moving the foot assembly 14 over a surface to be cleaned. When the separation/collection module 26 is received in the mounting section 24, as shown in FIG. 1, the separation/collection module 26 is in fluid communication with, and fluidly positioned between, the suction nozzle 30 and the vacuum fan/motor assembly within the motor cavity 20. At least a portion of the working air pathway between the suction nozzle 30 and the separation/collection module 26 can be formed by a vacuum hose 34 that can be selectively disconnected from fluid communication with the suction nozzle 30 for above-the-floor cleaning.

Figure 2:
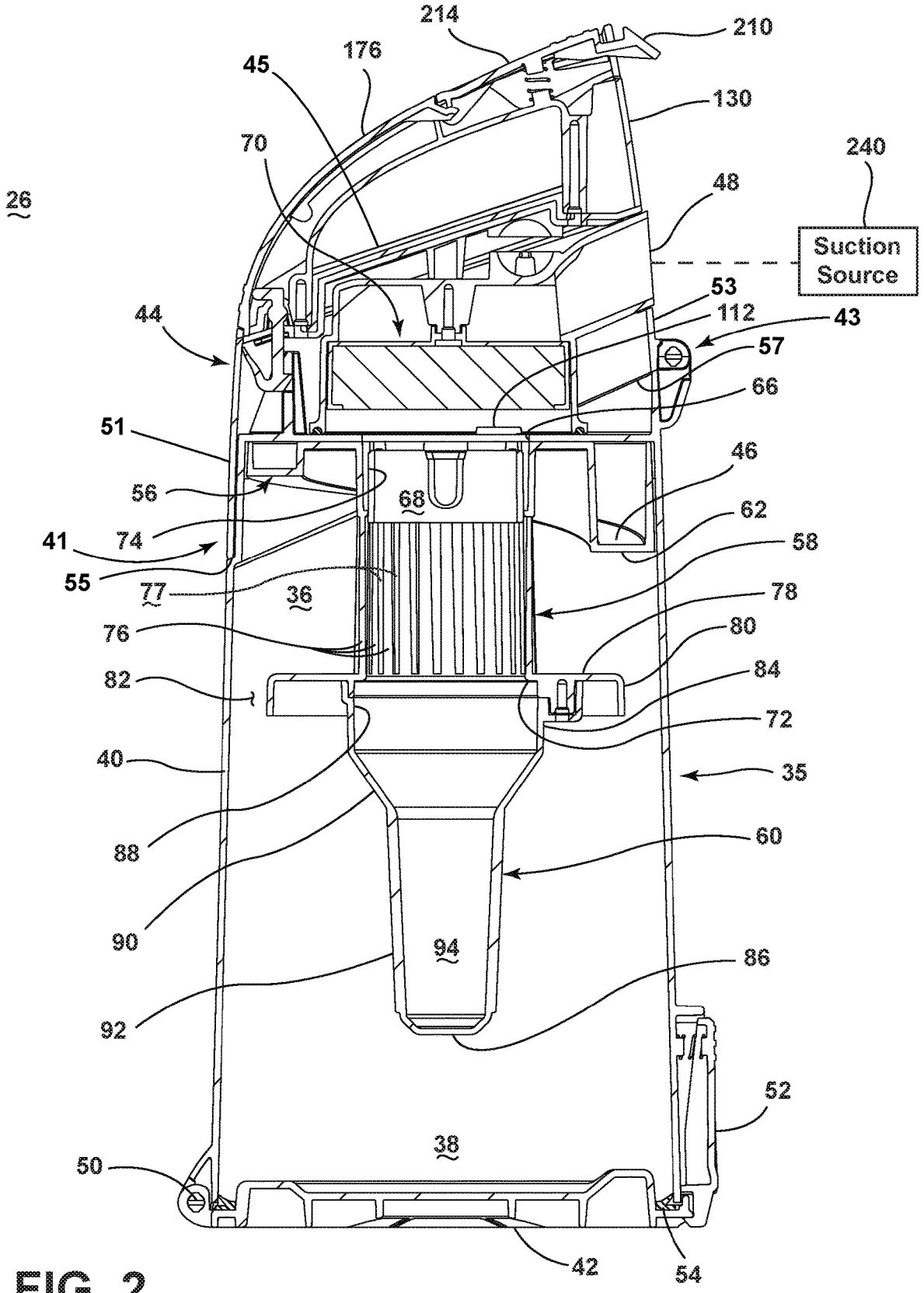
FIG. 2 is a cross-sectional view through a separation/collection module of the vacuum cleaner, taken through line II-II of FIG. 1.

Referring to FIG. 2, the separation/collection module 26 of the first at comprises a housing 35 at least partially defining a cyclone separator having a single-stage cyclone chamber 36 for separating contaminants from a dirt-containing working airstream and an integrally-formed dirt collection chamber 38 which receives contaminants separated by the cyclone chamber 36.

Figure 3:
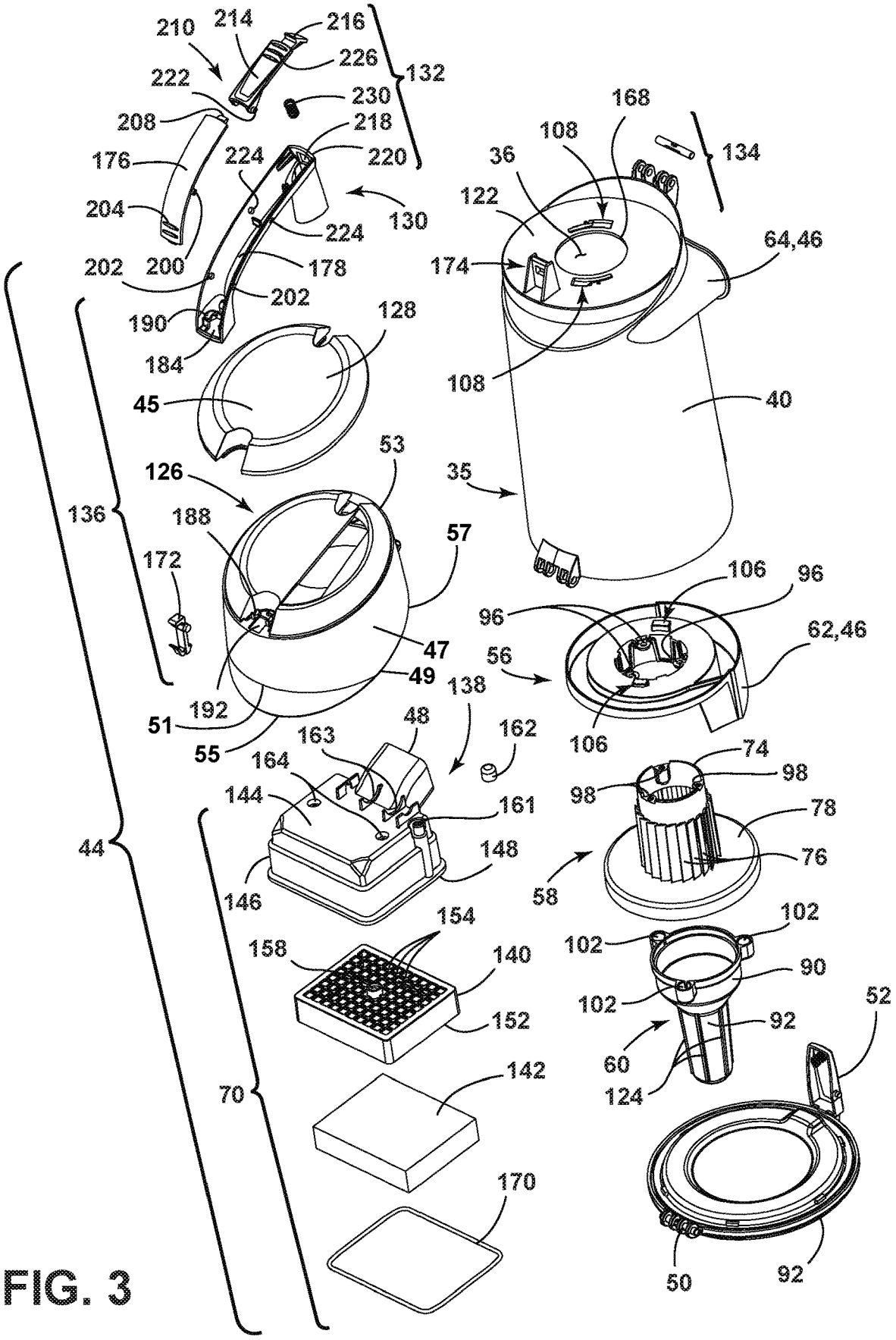
FIG. 3 is an exploded view of the separation/collection module from FIG. 2.
Figure 12:
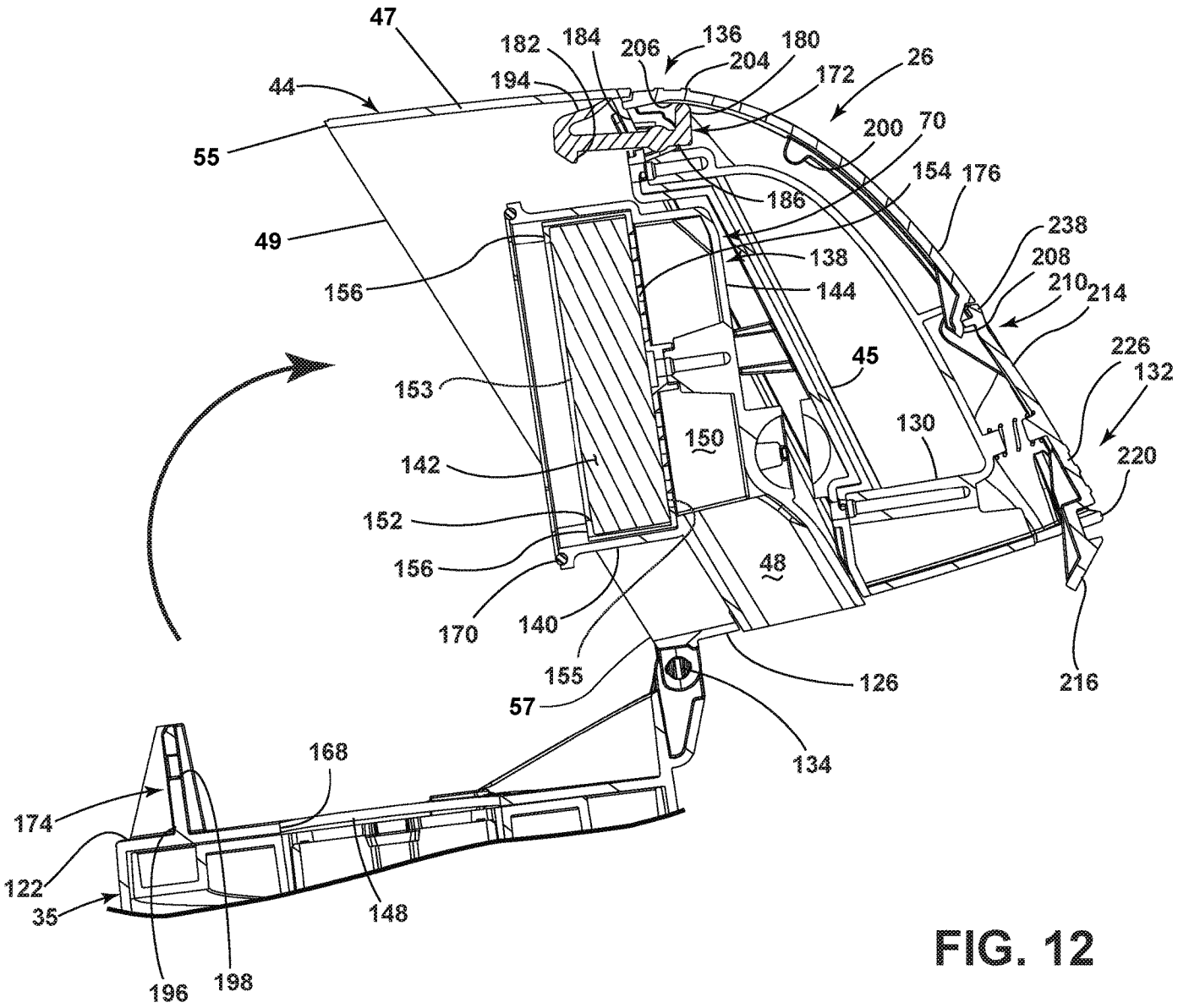

The module housing 35 is common to the cyclone chamber 36 and the collection chamber 38, and includes a side wall 40, a bottom wall 42, and a cover 44. The side wall 40 is illustrated herein as being generally cylindrical in shape, with a diameter that increases in a direction toward the bottom wall 42. The bottom wall 42 comprises a dirt door that can be selectively opened, such as to empty the contents of the collection chamber 38. An inlet to the separation/collection module 26 can be at least partially defined by an inlet conduit 46. An outlet from the separation/collection module 26 can be at least partially defined by an outlet conduit 48 extending from the cover 44. With reference to FIGS. 2, 3, and 12, the cover 44 includes an upper surface 45 that forms an outer surface of the vacuum cleaner 10 and a depending side surface 47 having a bottom edge 49. As shown, the upper surface 45 of the cover 44 is angled forwardly at an incline, with a forwardmost portion 41 of the cover 44 being lower than a rearmost portion 43 of the cover 44. More specifically, the upper surface 45 of the cover 44 is angled forwardly at an incline, with a forwardmost portion 51 of the side surface 47 being lower than a rearmost portion 53 of the side surface 47, and the bottom edge 49 of the cover 44 is angled forwardly at an incline, with a forwardmost portion 55 of the bottom edge 49 being lower than a rearmost portion 57 of the bottom edge 49. The inlet conduit 46 is in fluid communication with the suction nozzle 30 (FIG. 1) and the outlet conduit 48 is in fluid communication with a suction source 240, such as a vacuum fan/motor assembly, within the motor cavity 20 (FIG. 1).

While the cyclone chamber 36 and collection chamber 38 are shown herein as being integrally formed, it is also contemplated that the separation/collection module 26 can be provided with a separate dirt cup having a closed or fixed bottom wall and that is removable from the cyclone chamber 36 to empty dirt collected therein. Furthermore, while a single-stage cyclone is illustrated herein, it is also contemplated that the separation/collection module 26 can be configured with multiple separation stages. As illustrated herein, the separation and collection module is shown as a cyclone module 26. However, it is understood that other types of separation modules can be used, such as centrifugal separators or bulk separators.

The dirt door 42 is pivotally mounted to the side wall 40 by a hinge 50. A door latch 52 is provided on the side wall 40, opposite the hinge 50, and can be actuated by a user to selectively release the dirt door 42 from engagement with the bottom edge of the side wall 40. The door latch 52 is illustrated herein as comprising a latch that is pivotally mounted to the side wall 40 and spring-biased toward the closed position shown in FIG. 2. By pressing the upper end of the door latch 52 toward the side wall 40, the lower end of the door latch 52 pivots away from the side wall 40 and releases the dirt door 42, under the force of gravity, allowing accumulated dirt to be emptied from the collection chamber 38 through the open bottom of the module housing 35. A gasket 54 can be provided between the dirt door 42 and the bottom edge of the side wall 40 to seal the interface therebetween when the dirt door 42 is closed.

The separation/collection module 26 further includes an interior assembly that includes a mounting plate 56, an exhaust grill 58 for guiding working air from the cyclone chamber 36 out of the separation/collection module 26, and a fines catcher 60 for collecting fine dirt. The interior assembly can be configured to be removable as one unit from the separation/collection module 26 without the use of tools. The exhaust grill 58 is positioned in the center of the cyclone chamber 36 and depends from the mounting plate 56. The fines catcher 60 is also positioned in the center of the cyclone chamber 36 and depends from the exhaust grill 58. As illustrated herein, the mounting plate 56, the exhaust grill 58, and the fines catcher 60 can be separately formed; alternatively, two or more of the components can be integrally formed with each other.

The mounting plate 56 can comprise at least a portion of the inlet conduit 46 which defines the inlet to the separation/collection module 26. As shown herein, an interior portion 62 of the inlet conduit 46 can be integrally formed with the mounting plate 56, while an exterior portion 64 of the inlet conduit 46, shown in FIG. 1, can be integrally formed with and extending outwardly from the side wall 40 of the module housing 35. When the mounting plate 56 is mounted within the cyclone chamber 36, the interior and exterior portions 62, 64 communicate with each other, and form one essentially continuous inlet conduit 46. The mounting plate 56 further includes a central opening 66 allowing air to pass out of the exhaust grill 58.

The exhaust grill 58 separates the cyclone chamber 36 from a passageway 68 leading to a pre-motor filter assembly 70 within the cover 44, and includes a generally cylindrical body having an open lower end 72, an open upper end 74 which is connected to the mounting plate 56, and a plurality of vanes or louvers 76 extending longitudinally between the lower and upper ends 72, 74 and form corresponding openings 77 between the louvers 76 through which air can pass. As illustrated, the louvers 76 are vertically-oriented. The lower end 72 includes a separator plate 78 extending radially outwardly from the cylindrical body and includes a downwardly depending peripheral lip 80. A debris outlet 82 from the cyclone chamber 36 can be defined between the separator plate 78 and the side wall 40. While not shown, a foam filter may be provided on the exterior or interior of the exhaust grill 58.

The fines catcher 60 comprises a tubular body 84 having a closed bottom end 86 and an open upper end 88 that is mounted to the open lower end 72 of the exhaust grill 58. The tubular body 84 includes an upper frusto-conical portion 90 and a lower closed portion 92 that defines an interior collection chamber 94 in which fine dirt particles are collected.

FIG. 3 is an exploded view of the separation/collection module from FIG. 2. The mounting plate 56 may be provided with one or more fastener openings 96 and the exhaust grill 58 may be provided with one or more corresponding fastener openings 98 on the open upper end 74 that are configured to be aligned and to receive fasteners (not shown) that can be used to fasten the exhaust grill 58 to the mounting plate 56. Thus, the illustrated exhaust grill 58 is not removable from the mounting plate 56 without the use of tools. Alternatively, the exhaust grill 58 can be configured to be removed from the mounting plate 56 without the use of tools, such as by providing a bayonet-type or twist-lock attachment mechanism.

The exhaust grill 58 may further be provided with one or more fastener bosses (not shown) on the underside of the separator plate 78 and the fines catcher 60 may be provided with one or more corresponding fastener bosses 102 on the frusto-conical portion 90 that are configured to be aligned and to receive fasteners (not shown) that can be used to fasten the fines catcher 60 to the exhaust grill 58. Thus, the illustrated fines catcher 60 is not removable from the exhaust grill 58 without the use of tools. Alternatively, the fines catcher 60 can be configured to be removed from the exhaust grill 58 without the use of tools, such as by providing a bayonet-type or twist-lock attachment mechanism.

The mounting plate 56 can be used to mount the interior portion 62 of the inlet conduit 46 within the module housing 35 by attaching the mounting plate 56 underneath the cover 44. An attachment mechanism can be provided for removably attaching the mounting plate 56 within the cyclone chamber 36. As illustrated herein, the attachment mechanism is a bayonet mount that includes two or more radially spaced tabs 106 provided on the upper surface of the mounting plate 56 and two or more corresponding slots 108 provided at the top of the cyclone chamber 36. Thus, the illustrated mounting plate 56 is removable from the cyclone chamber 36 without the use of tools. It is understood that the tabs 106 and slots 108 of the bayonet mount can be reversed on the mounting plate 56 and cover 44. Other attachment mechanisms that do not require tools to remove can be used, including threaded attachments, press-fits, snaps, clips, etc.

The lower closed portion 92 of the fines catcher 60 can be configured to serve as a handle, grip or hand-hold for the interior assembly. As illustrated, the lower closed portion 92 has a smaller diameter than the upper frusto-conical portion 90, and is more ergonomic and comfortable for a user to grip. The lower closed portion 92 includes a gripping portion on its exterior surface that facilitates a secure grip on the fines catcher 60. In one aspect, the gripping surface comprises a plurality of vertically-extending ribs 124. A user can grasp the fines catcher 60 when assembling or disassembling the interior assembly according to the process shown in FIGS. 4-5.

Figure 4:
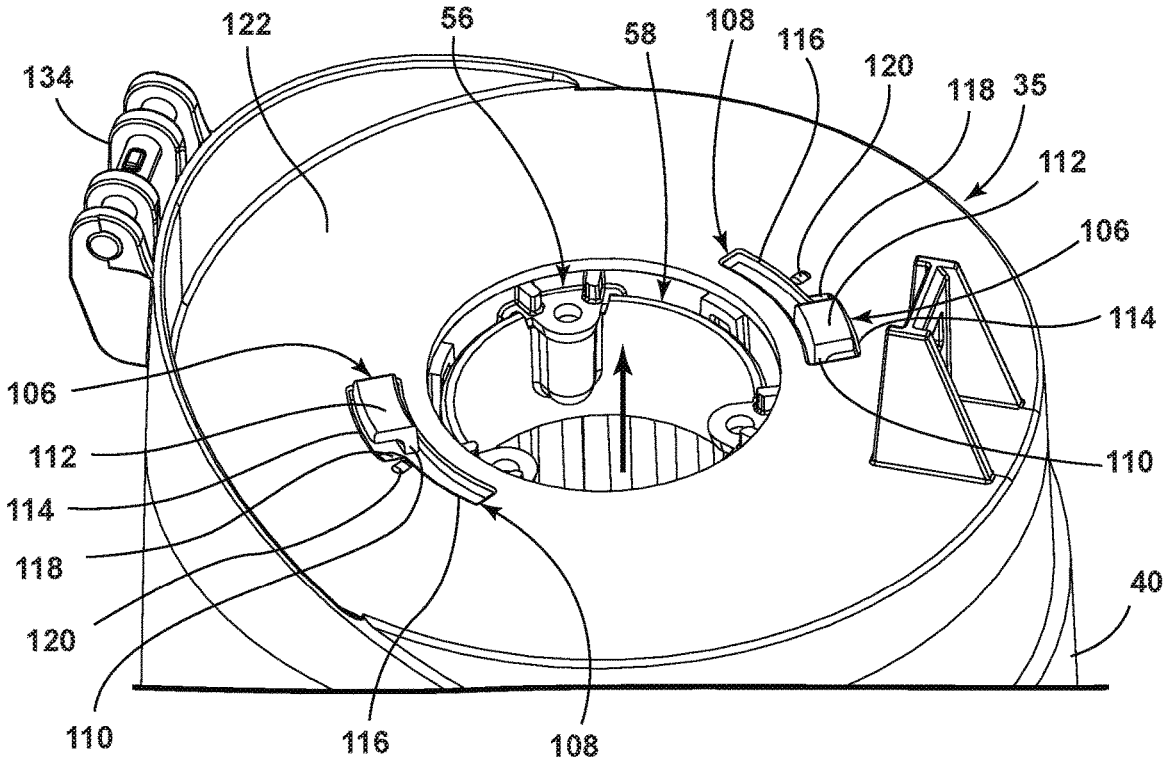
FIGS. 4-5 illustrate the coupling of an interior assembly within the separation/collection module via a bayonet mount.
Figure 5:
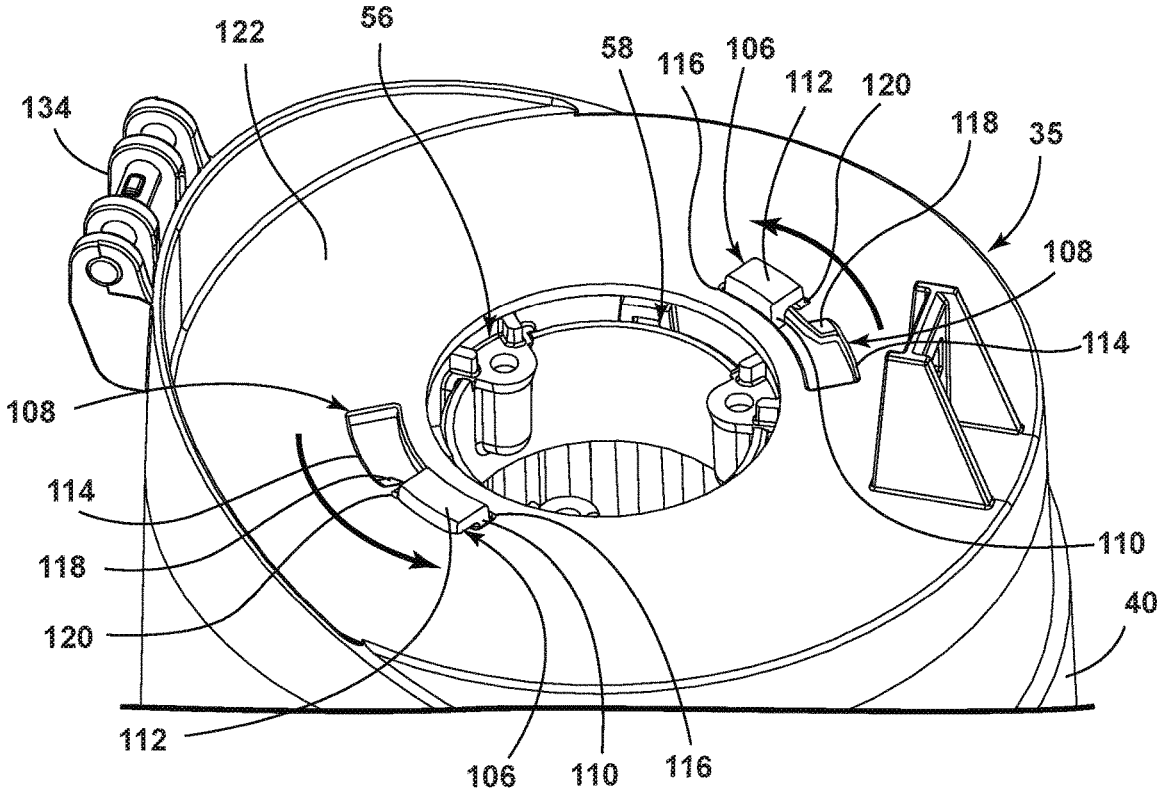

FIGS. 4-5 illustrate the coupling of the interior assembly via the bayonet mount. As shown herein, two opposing tabs 106 are provided and are generally L-shaped, with a neck 110 extending away from the upper surface of the mounting plate 56 and a free end 112 extending outwardly from the neck 110. Two corresponding, opposing slots 108 are also provided, and are configured to receive the tabs 106. Each slot 108 includes a wider slot opening 114 and a narrower slot passage 116 extending from the slot opening 114. The slot opening 114 is sized to allow for the passage of the free end 112 of the tab 106 to pass therethrough, while the slot passage 116 is sized to allow the neck 110 of the tab 106 to slide along the passage 116 but not to allow the free end 112 of the tab 106 to pass therethrough. A ramp 118 is provided at one end of the slot opening 114, adjacent to the slot passage 116, to guide the free end 112 of the tab 106 upwardly and over the exterior side of the slot 108. A detent 120 is provided near the top of the ramp 118, and helps retain the free end 112 of the tab 106 in a locked position.

To couple the interior assembly to the module housing 35 via the bayonet mount, the free ends 112 of the tabs 106 on the mounting plate 56 are aligned with the slot openings 114 in the module housing 35. The mounting plate 56 and module housing 35 are then moved together, such as by lifting the mounting plate 56 as indicated by the arrow in FIG. 4, to seat the tabs 106 in the slots 108. The mounting plate 56 and the module housing 35 are then rotated relative to each other, as indicated by the arrows in FIG. 5, so that the neck 110 of the tabs 106 slide into the slot passage, with the free end 112 of the tabs 106 rising up the ramps 118 and over the upper wall 122 of the module housing 35. The free ends 112 move past the detents 120 to lock the mounting plate 56 in the position shown in FIG. 5.

The number and shape of tabs and slots on the bayonet mount can be varied while still maintaining an easy connection interface. To prevent misassembly by a user, the tabs 106 and slots 108 can be positioned around the mounting plate 56 and upper wall 122 in an irregular pattern to ensure that the mounting plate 56 can be assembled to the module housing 35 in one orientation only. While the slots 108 are illustrated as being formed in an upper wall 122 of the module housing 35, it is understood that the slots 108 could be located in any component of the separator/collector module 26 such that the interior assembly can be removed from the cyclone chamber 36. For example, the slots 108 can alternatively be formed in an underside of the cover 44. Furthermore, the location of the tabs 106 and slots 108 can be reversed on the mounting plate 56 and the module housing 35.

Figure 6:
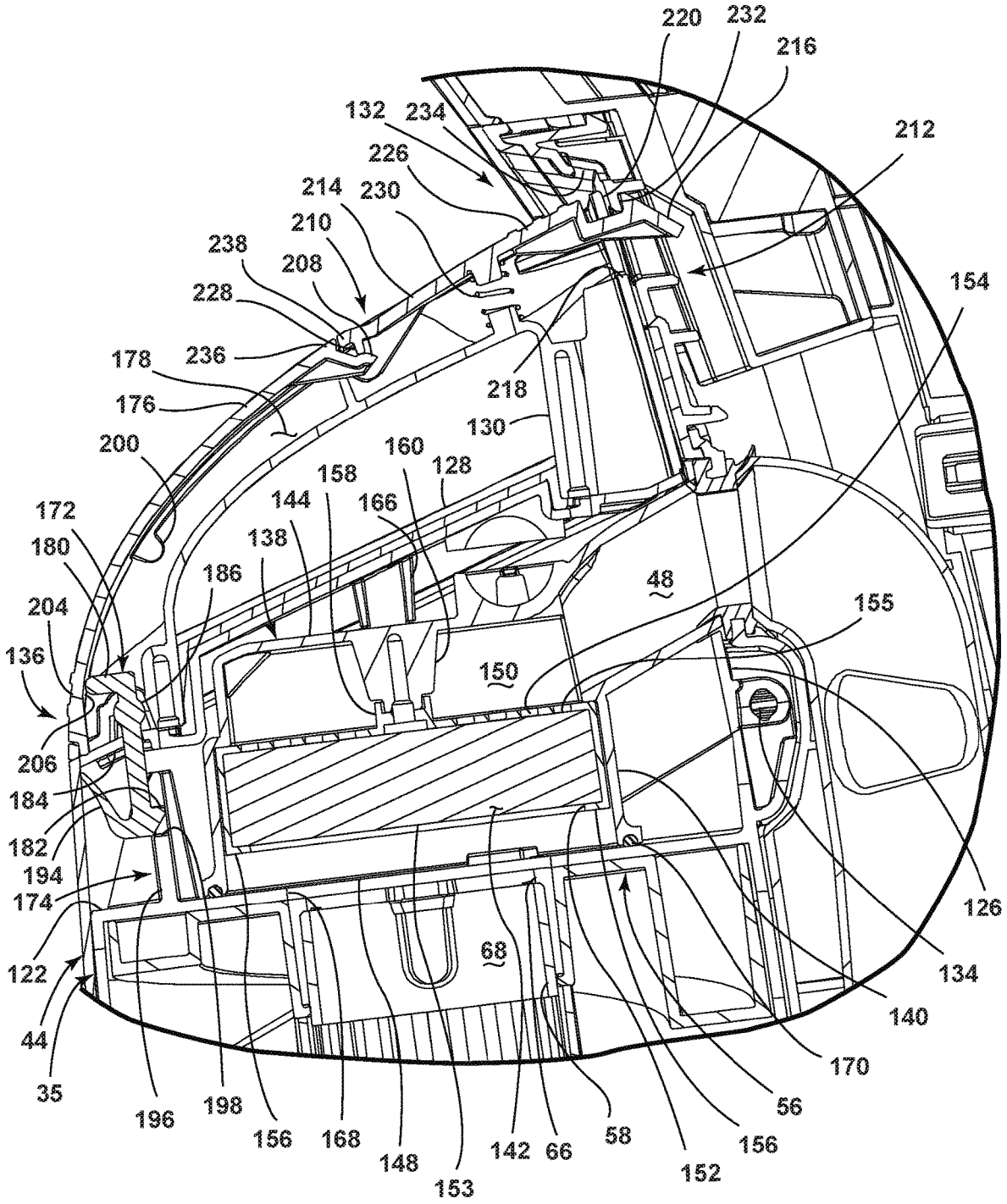
FIG. 6 is a close-up, cross-sectional view of the separation/collection module taken through line II-II of FIG. 1.

FIG. 6 is a close-up, cross-sectional view of the separation/collection module taken through line II-II of FIG. 1. The cover 44 includes a cover lid 126, a cover cap 128 for covering the upper surface of the cover lid 126, and a handle grip 130 attached to the cover lid 126 that can be gripped by a user to facilitate lifting and carrying the entire vacuum cleaner 10 or just the separation/collection module 26 when removed from the vacuum cleaner 10. The cover 44 can further include a module latch assembly 132, the pre-motor filter assembly 70 and the outlet conduit 48 for exhausting working air from the separation/collection module 26. The cover 44 can be pivotally mounted to the module housing 35 by a hinge 134. A cover latch assembly 136 can be provided opposite the hinge 134, and can be actuated by a user to selectively release the cover 44 from the closed position shown in FIG. 2.

The pre-motor filter assembly 70 includes a filter housing 138, a filter tray 140 removably mounted within the filter housing 138, and a filter media 142 removably received by the filter tray 140. The filter housing 138 includes a top wall 144, a peripheral side wall 146, and an open bottom 148, which together defines a filter chamber 150. The outlet conduit 48 can communicate with the filter chamber 150 to conduct working air that has been filtered by the filter media 142 toward the suction source. As illustrated herein, the outlet conduit 48 can be integrally formed with the filter housing 138, and can extend from the side wall 146.

The filter tray 140 is provided within the filter chamber 150 and can have one or more filter inlets 152 and one or more filter outlets 154 which allow working air to pass through the filter media 142 retained within the filter tray 140, from an upstream surface 153 of the filter media 142 to a downstream surface 155 of the filter media 142. The outlet conduit 48 can communicate with the filter chamber 150 downstream of the filter media 142 (i.e., downstream of the filter outlet 154) to conduct working air that has been filtered by the filter media 142 toward the suction source.

The filter tray 140 can be configured such that a user does not need to remove the filter tray 140 from the filter housing 138 in order to change the filter media 142. The filter tray 140 may be attached to the filter housing 138 using a fastening means, and the filter media 142 can be configured for an interference fit with the tray 140. The filter tray 140 may be provided with flanges 156 for retaining the filter media 142 within the filter tray 140. As illustrated, the filter tray 140 and filter housing 138 are provided with corresponding fastener receivers 158, 160 that are configured to be aligned and to receive a fastener (not shown) that can be used to fasten the filter tray 140 to the filter housing 138. Thus, the illustrated filter tray 140 is not removable from the filter housing 138 without the use of tools. Alternatively, the filter tray 140 can be configured to be removed from the filter housing 138 without the use of tools, such as by providing a bayonet-type or twist-lock attachment mechanism. Other mechanisms that do not require tools for removal can be used, including threaded attachments, press-fits, snaps, clips, etc.

The filter media 142 can comprise a non-porous or porous media, or a pleated or non-pleated media. For example, the filter media can be a non-porous, pleated filter, such as a HEPA filter. In another example, the filter media can be a porous, non-pleated filter, such as a sponge-type filter.

A plug 162 seals a corresponding hollow vacuum port 161 on the filter housing 138. The port 161 is fluidly connected to the filter chamber 150. In another aspect, the plug 162 can be omitted and replaced by a clogged filter indicator (not shown), which can be mounted within corresponding cradle ribs 163 on the top wall 144. The clogged filter indicator can comprise a pressure sensor fluidly connected to the port 161 and adapted to sense pressure within the filter chamber 150. The clogged filter indicator can be configured to visually indicate a clogged filter condition to a user though an aperture (not shown) in the cover lid 126 and cover cap 128 when the air flow restriction through the filter media 142 increases beyond a predetermined level, which, in turn actuates the pressure sensor.

With reference to FIGS. 3 and 6, the filter housing 138 can be attached to the cover 44 for movement therewith. As shown herein, the filter housing 138 and the cover lid 126 may be provided with one or more corresponding fastener receivers 164, 166 that are configured to be aligned and to receive fasteners (not shown) that can be used to fasten the filter housing 138 to the cover 44. Thus, the illustrated filter housing 138 is not removable from the cover 44 without the use of tools. Alternatively, the filter housing 138 can be configured to be removed from the cover 44 without the use of tools, such as by providing a bayonet-type or twist-lock attachment mechanism, threaded attachments, press-fits, snaps, clips, etc.

When the cover 44 is closed as shown in FIG. 6, the filter housing 138 rests against the upper wall 122 of the module housing 35 such that the open bottom 148 is in fluid communication with a central opening 168 in the upper wall 122, which is aligned with the central opening 66 of the mounting plate 56. The filter chamber 150 is thus in fluid communication with the passageway 68 within the exhaust grill 58. A bottom edge of the filter housing 138 can be provided with a gasket 170 for sealing the interface between the filter housing 138 and the upper wall 122 of the module housing 35 when the cover 44 is closed.

The filter assembly 70 can be accessible to a user for periodic cleaning and/or replacement of the filter media 142 by opening the cover 44. The cover 44 is provided with the cover latch assembly 136 for selectively latching the cover 44 in a closed position shown in FIG. 2. The cover latch assembly 136 includes a latch 172 on the cover 44, a latch receiver 174 provided on the module housing 35, and an elongated cover latch actuator 176 received in an open channel 178 formed in the handle grip 130. The cover latch actuator 176 hides the latch 172 from view, which provides an improved aesthetic appearance to the module 26 over other types of latches that are visible.

The latch 172 of the cover latch assembly 136 includes a striker 180 and a catch 182 operably coupled with the striker 180, such that movement of the striker 180 is translated to movement of the catch 182. In the illustrated aspect, the striker 180 and catch 182 are integrally formed with each other, and the latch 172 extends through a slot 184 in the handle grip 130, such that the striker 180 is interior of the handle grip 130 and the catch 182 is exterior of the handle grip 130. The latch 172 further includes two opposed pivot arms 186 that are mounted within pivot receivers adjacent to the slot 184, such that the latch 172 is pivotally moveable within the slot 184, relative to the handle grip 130. The pivot receivers can include cradle portions 188 provided on the cover lid 126 and cover portions 190 provided on the handle grip 130 that cooperate to form a pivot bearing for the pivot arms 186. The cover lid 126 is provided with a latch opening 192 adjacent cradle portions 188 which allows for free pivoting of the latch 172 relative to the cover lid 126. A spring arm 194 can be integrally formed with the latch 172 and normally biases the latch 172 to a locked position shown in FIG. 6. The latch receiver 174 includes a plate 196 extending upwardly from the upper wall 122 of the module housing 35, and a catch receiver 198 formed in the plate 196.

The cover latch actuator 176 is moveably mounted to the handle grip 130, and includes opposing pivot arms 200 that are received within pivot openings 202 formed in the handle grip 130. The cover latch actuator 176 can pivot relative to the open channel 178 about an axis defined by the pivot arms 200. A user-engageable press surface 204 is provided on the exterior side of one end of the cover latch actuator 176 and a striking surface 206 is provided on the interior side of the same end of the cover latch actuator 176; both the press surface 204 and striking surface 206 are spaced from the pivot arms 200. The opposite end of the cover latch actuator 176 includes a bearing surface 208.

The module latch assembly 132 includes a latch 210 on the separator/collection module 26 and a latch receiver 212 provided on the upright assembly 12. The latch 210 includes an elongated module latch actuator 214 received in the open channel 178 formed in the handle grip 130 and a catch 216 operably coupled with the module latch actuator 214. In the illustrated aspect, the actuator 214 and catch 216 are integrally formed with each other, and the module latch actuator 214 extends through a slot 218 in the handle grip 130 to the catch 216, such that the catch 216 is exterior of the handle grip 130. A stop 220 is formed on the end of the handle grip 130 near the slot 218 and extends upwardly above the module latch actuator 214.

The module latch actuator 214 is moveably mounted to the handle grip 130, and includes opposing pivot arms 222 that are received within pivot openings 224 formed in the handle grip 130. The module latch actuator 214 can pivot relative to the open channel 178 about an axis defined by the pivot arms 222. A user-engageable press surface 226 is provided on one end of the module latch actuator 214, near the catch 216, and is spaced from the pivot arms 222. The opposite end of the module latch actuator 214 partially retains the adjacent end of the latch actuator 176 and includes a bearing surface 228 that engages with the bearing surface 208 on the cover latch actuator 176 to prevent binding of the overlapping ends of the cover latch actuator 176 and module latch actuator 214 during actuation. A spring 230 normally biases the module latch actuator 214 to a locked position shown in FIG. 6.

The catch 216 engages a complementary latch receiver 212 on the upright handle 12 to secure the separation/collection module 26 within the mounting section 24. The latch receiver 212 includes a keeper 232 formed in a front side of the primary support section 16 by an opening near an upper end of the mounting section 24. The latch receiver 212 further includes a pocket 234 above the keeper 232 that is oriented generally downwardly, such that the opening of the pocket 234 faces the keeper 232.

The handle grip 130 is provided with the actuators 176, 214 for both the cover latch assembly 136 and the module latch assembly 132. The actuators 176, 214 can be configured to present a generally smooth, uninterrupted surface for the user to grip. The press surfaces 204, 226 of the actuators 176, 214 are located at the terminal ends of the handle grip 130, so that a user can comfortably grasp the handle grip 130 without inadvertently actuating the latch assemblies 132, 136. The ends 236, 238 of the actuators 176, 214 opposite the press surfaces 204, 226 can be beveled in complementary manner to present a generally smooth, continuous gripping surface. The bearing surfaces 208, 228 prevent binding of the overlapping ends of the cover latch actuator 176 and module latch actuator 214 when the corresponding press surfaces 204, 226 are depressed.

Figure 7:
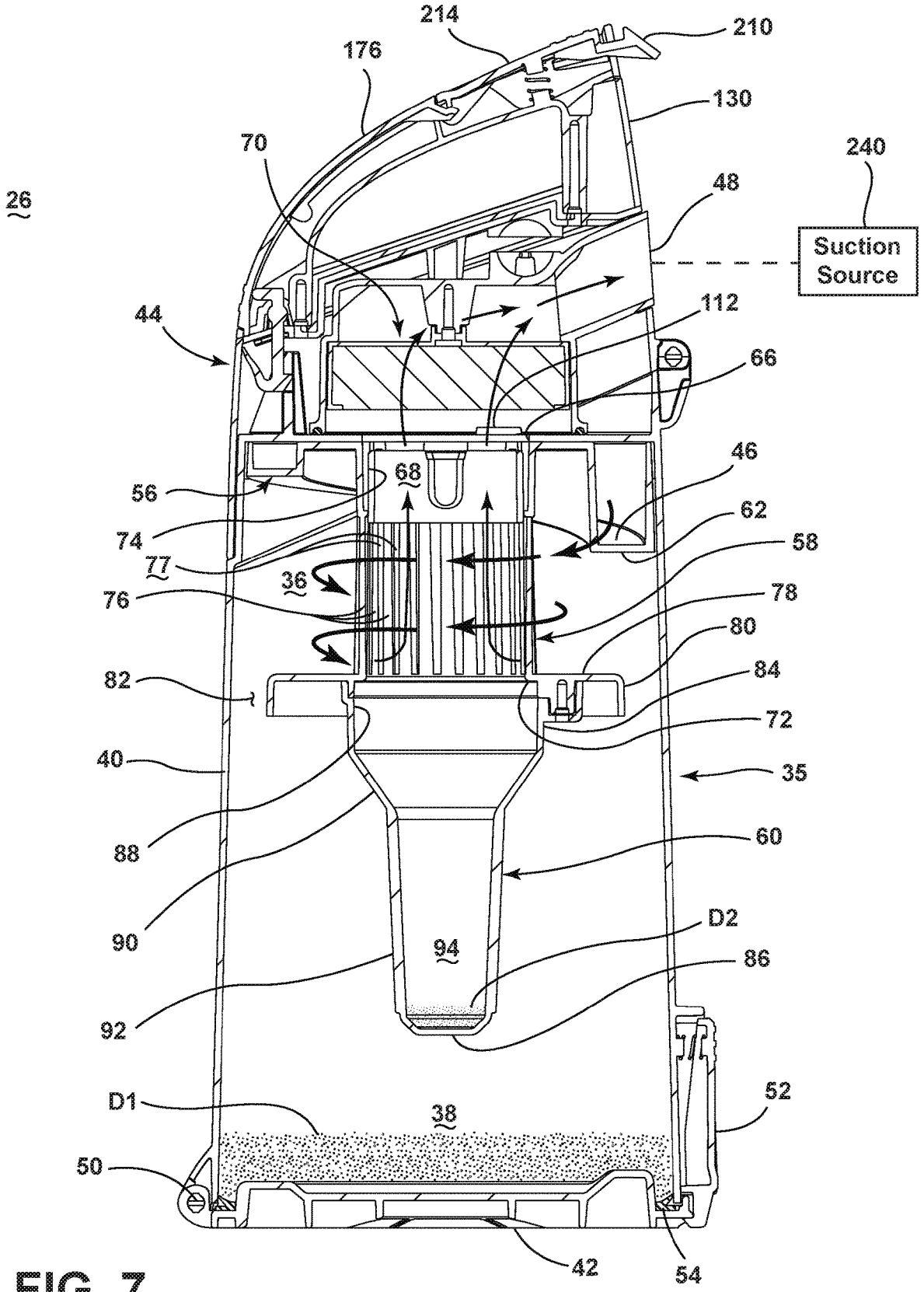
FIG. 7 is a cross-sectional view of the separation/collection module similar to FIG. 2, showing the flow path of working air through the separation/collection module.

Referring to FIG. 7, in which the flow path of working air is indicated by arrows, the operation of the separation/collection module 26 will be described. The suction source 240, when energized, draws dirt and dirt-containing air from the suction nozzle 30 (FIG. 1) to the inlet conduit 46 and into the separation/collection module 26 where the dirty air swirls around the cyclone chamber 36. It is noted that while the working air within the cyclone chamber 36 flows along an airflow path having both horizontal and vertical components with respect to a central axis of the module 26, the magnitude of the horizontal component is greater than the magnitude of the vertical component. Larger or coarser debris D1 falls into the collection chamber 38. The working air, which may still contain some smaller or finer debris, then passes between the louvers 76 of the exhaust grill 58 which can separate out some additional debris. The working air continues to swirl around the inside of the exhaust grill 58 and the frusto-conical portion 90, which causes smaller or finer debris D2 to separate and fall into the fines collection chamber 94 of the fines catcher 60. The working air, which may still contain some even smaller or finer debris, proceeds upwardly within the passageway 68 and enters the pre-motor filer assembly 70, where additional debris may be captured by the filter media 142. The working air then exits the separation/collection module 26 via the outlet conduit 48, and passes through the suction source 240 before being exhausted from the vacuum cleaner 10. One or more additional filter assemblies may be positioned upstream or downstream of the suction source 240. To dispose of collected dirt and dust, the separation/collection module 26 is detached from the vacuum cleaner 10 to provide a clear, unobstructed path for the debris captured in the collection chamber 38 to be removed.

Figure 8:
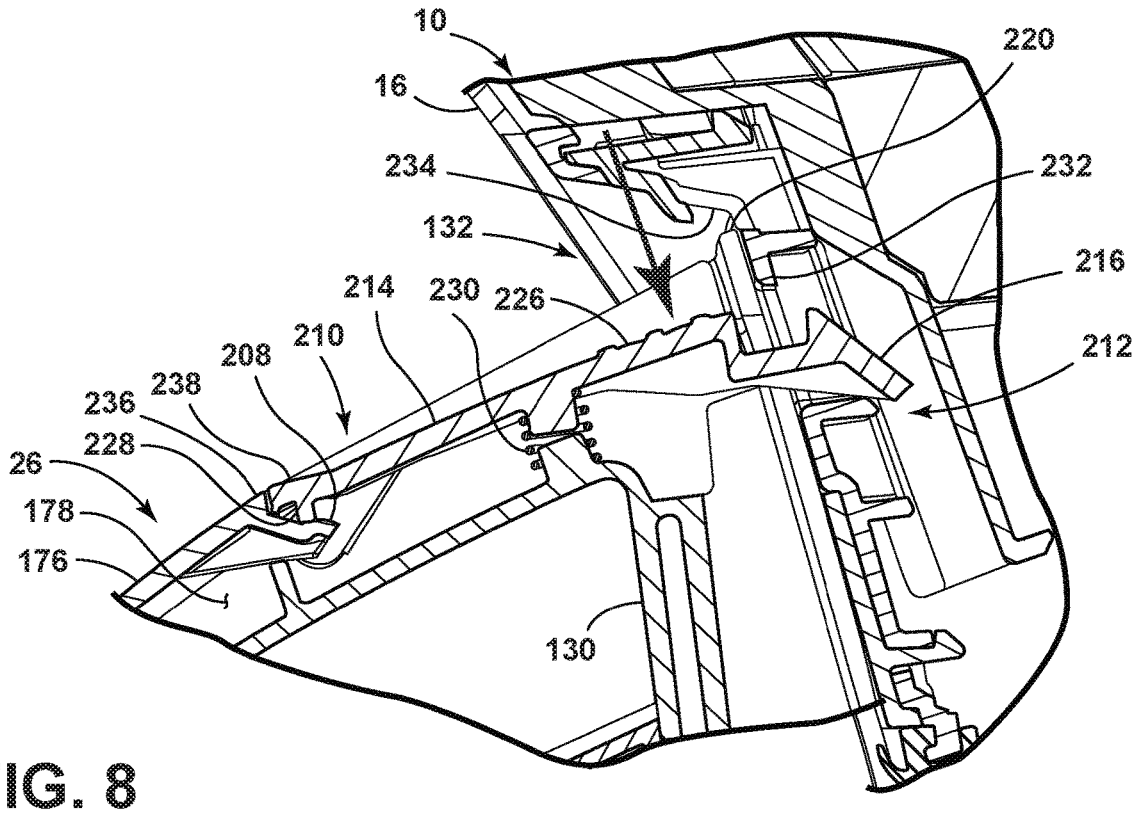
FIGS. 8-9 illustrate the removal of the separation/collection module from the vacuum cleaner.
Figure 9:
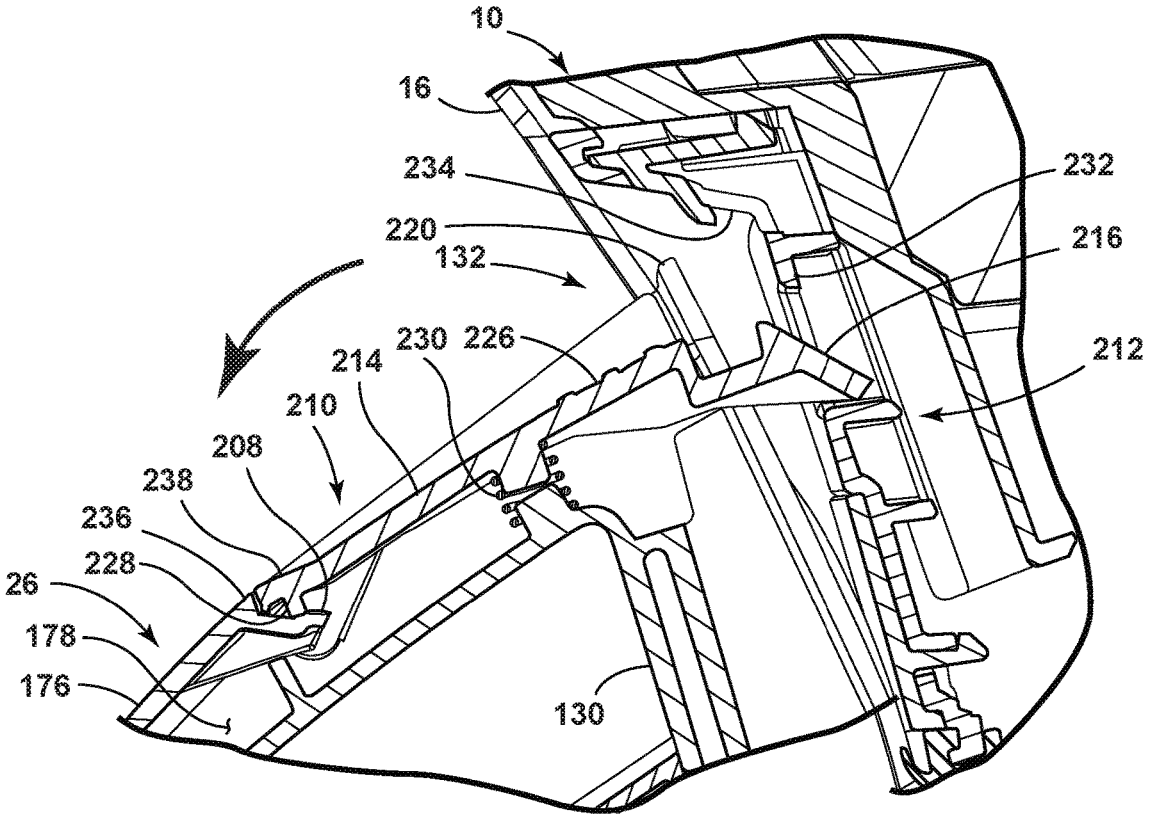

FIGS. 8-9 illustrate the steps of removing the separation/collection module 26 from the vacuum cleaner 10. Pressing the press surface 226 rotates the catch 216 downwardly to an unlocked position shown in FIG. 8. When the press surface 226 is depressed, the module latch actuator 214 pivots downwardly, moving the catch 216 away from the keeper 232. Holding this position, the user can remove the separation/collection module 26 from the vacuum cleaner 10 by tilting the separation/collection module 26 away from the primary support section 16 of the vacuum cleaner 10 to clear the latch 210 from the latch receiver 212, as shown in FIG. 9, and then lifting the separation/collection module 26 away from the vacuum cleaner 10. The removal of the separation/collection module 26 from the vacuum cleaner 10 is designed for convenient one-handed operation, by which the user can grasp the separation/collection module 26 by wrapping his/her fingers around the handle grip 130 and operate the press surface 226 with his/her thumb.

Once the separation/collection module 26 is detached, dirt disposal is effected by opening the dirt door 42. To empty the fines catcher 60, or to clean the interior assembly, the interior assembly is removed from the module housing 35 as described above with respect to FIGS. 4-5. Once removed, the interior assembly can be inverted to empty the contents of the fines catcher 60 through the passageway 68.

Figure 10:
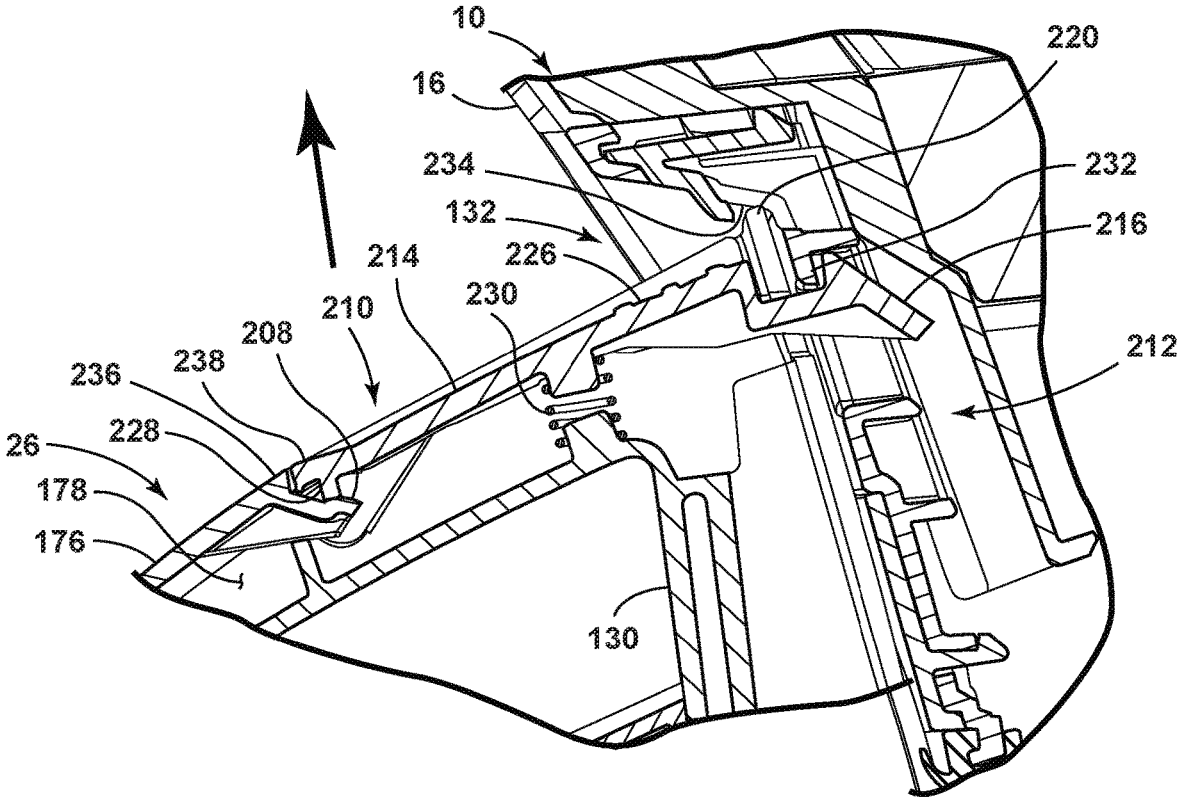
FIG. 10 illustrates the lifting of the separation/collection module without detaching the separation/collection module from the vacuum cleaner.

FIG. 10 illustrates a convenient way to carry the vacuum cleaner 10 by using the separation/collection module handle grip 130 without detaching the separation/collection module 26 from the vacuum cleaner 10. The pocket 234 and stop 220 protects the latch 210 if the user does not depress the module latch actuator 214 before lifting the separator/collection module 26, such is if the user uses the handle grip 130 to lift the entire vacuum cleaner 10, or if the user presses the module latch actuator 214 but does not tilt the separation/collection module 26 away from the mounting section 24 to clear the latch 210 from the latch receiver 212 before lifting the separator/collection module 26. When a user lifts the separator/collection module 26 by the handle grip 130, the stop 220 on the handle grip 130 bottoms out in the pocket 234, so that the latch 210 on the separator/collection module 26 does not bear the load.

Figure 11:
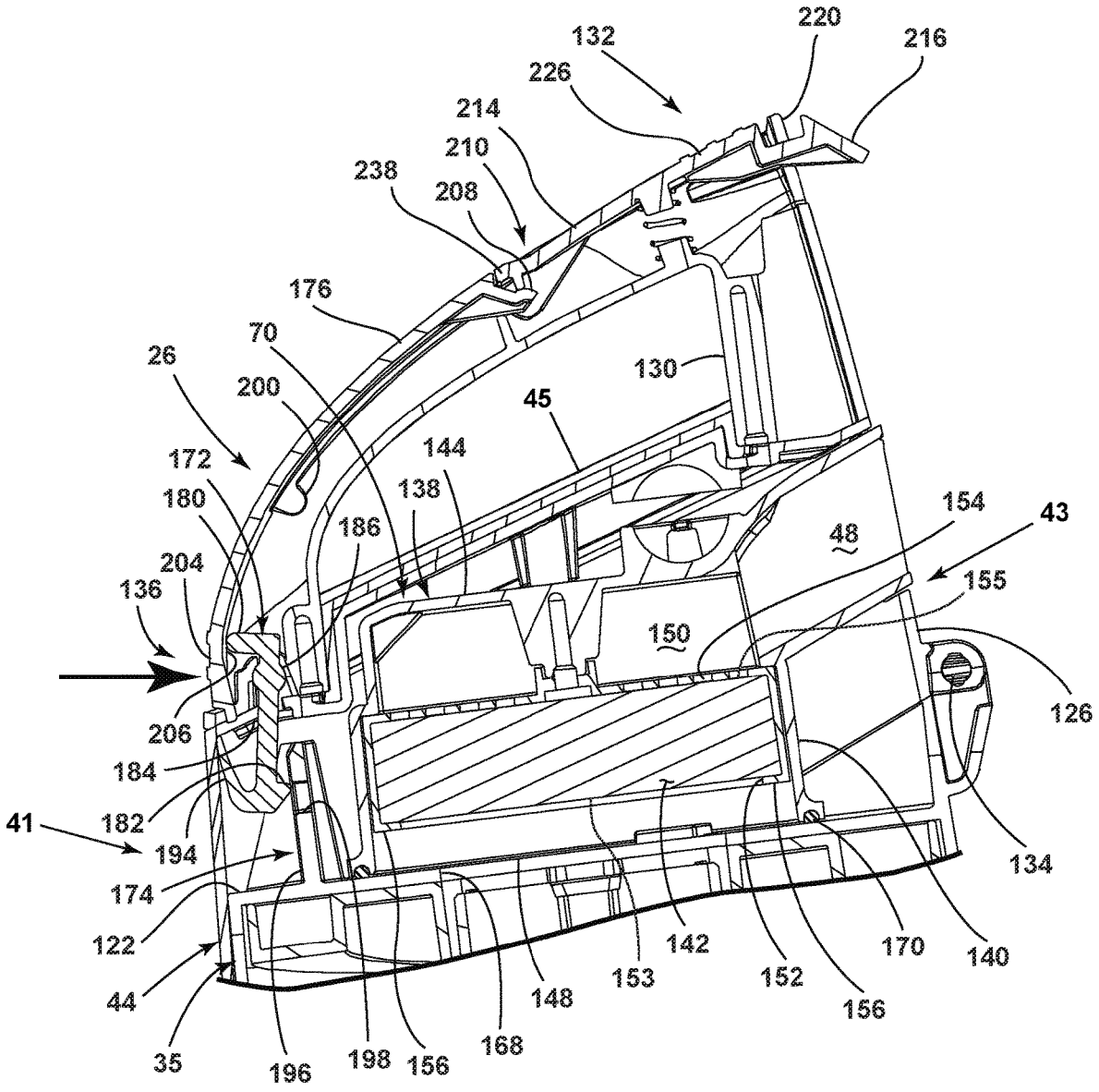
FIGS. 11-12 illustrate the steps for accessing a pre-motor filter assembly of the separation/collection module.

FIGS. 11-12 illustrate the steps for accessing the pre-motor filter assembly 70. To access the pre-motor filter assembly 70, such as to change or clean the filter media 142, the separation/collection module 26 must first be detached from the vacuum cleaner 10, in order to permit the opening of the cover 44. Pressing the press surface 204 rotates the striking surface 206 toward the striker 180 of the latch 172, which forces the latch 172 to rotate about the axis defined by the pivot arms 186 to an unlocked position shown in FIG. 11. In the unlocked position, the catch 182 is free of the catch receiver 198 and the spring arm 194 is compressed. Holding this position, the user can open the cover 44 by lifting up on the handle grip 130 to pivot the cover 44 around the hinge 134.

The opening of the cover 44 is designed for convenient one-handed operation, by which the user can grasp the separation/collection module 26 by wrapping his/her fingers around the handle grip 130 and operate the press surface 204 with his/her thumb. Furthermore, by placing the press surface 204 of the cover latch assembly 136 opposite the press surface 226 of the module latch assembly 132 on the handle grip 130, the user cannot comfortably grasp the handle grip 130 and operate both latch assemblies 132, 136 with their thumb.

Still further, opening the cover 44 exposes the upstream side of the pre-motor filter assembly 70. More specifically, when the cover 44 is open, the upstream surface 153 of the filter media 142 is viewable from a user's vantage point without removing any portion of the filter assembly 70 from the filter housing 138. Because the upstream surface 153 of the filter media 142 is the first portion of the filter media 142 exposed to working air during operation, it can capture more dirt, which is visible on the surface of the filter media 142, than other portions of the filter media 142, such as the downstream surface 155. So upon opening the cover 44, a user can immediately visually assess the condition of the filter media 142 such as whether the filter media 142 is soiled or clogged with dirt and whether the filter assembly 70 requires cleaning or replacement. The disclosed configuration of the filter assembly 70 is more convenient to use than other known configurations, which commonly hide the upstream surface of the filter within a filter housing and instead expose the downstream surface of the filter, which does not readily reveal fine dirt captured on the filter. So a user cannot immediately observe the condition of the filter and instead must first remove a portion of the pre-motor filter assembly from the filter housing to view the upstream surface in order to assess the condition of the filter media.

Figure 13:
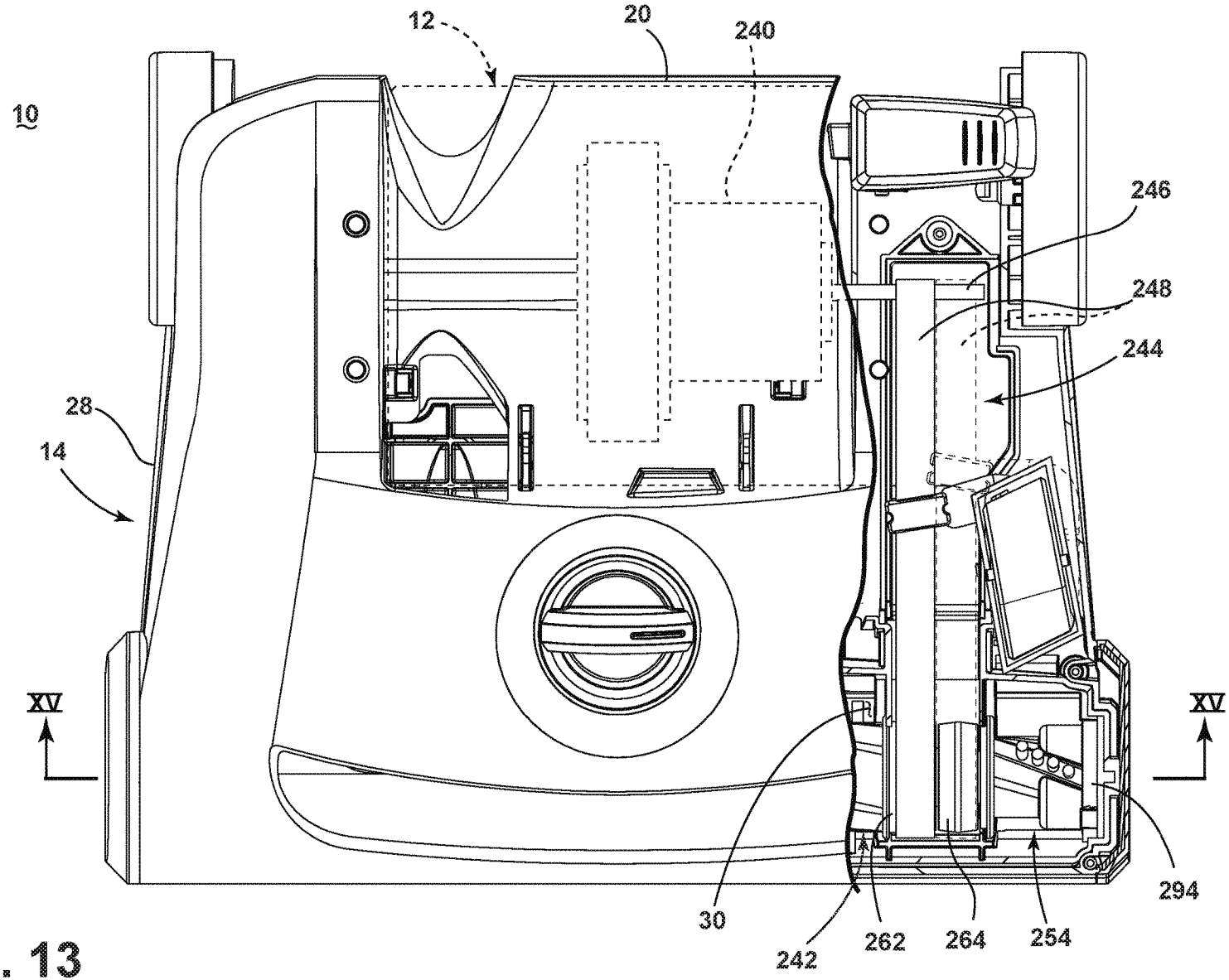
FIG. 13 is a top view of a vacuum cleaner according to a second aspect of the present disclosure, with a portion of vacuum cleaner cut away to show an agitator assembly, associated drive system and a belt shifter assembly.

FIG. 13 is a top view of a vacuum cleaner 10 according to a second aspect of the present disclosure. The vacuum cleaner 10 can be substantially similar to the vacuum cleaner 10 shown in FIG. 1, with the exception that a belt disengaging assembly can be provided so that the user can manually disengage an agitator drive system. FIG. 13 shows a lower portion of the handle assembly 12 and the foot assembly 14, with a portion of the housing 28 cut away so that an agitator assembly 242, associated drive system and belt shifter assembly 244 are visible. The agitator assembly 242 is positioned within the housing 28, adjacent the suction nozzle 30 and operably connected to the suction source 240 within the motor cavity 20. The suction source 240, such as a vacuum fan/motor assembly, is oriented transversely within the motor cavity 20 and comprises a motor shaft 246 which is oriented substantially parallel to the surface to be cleaned and protrudes from the motor cavity 20 into a rear portion of the housing 28. A stretch belt 248 operably connects the motor shaft 246 to the agitator assembly 242 for transmitting rotational motion of the motor shaft 246 to the agitator assembly 242.

Figure 14:
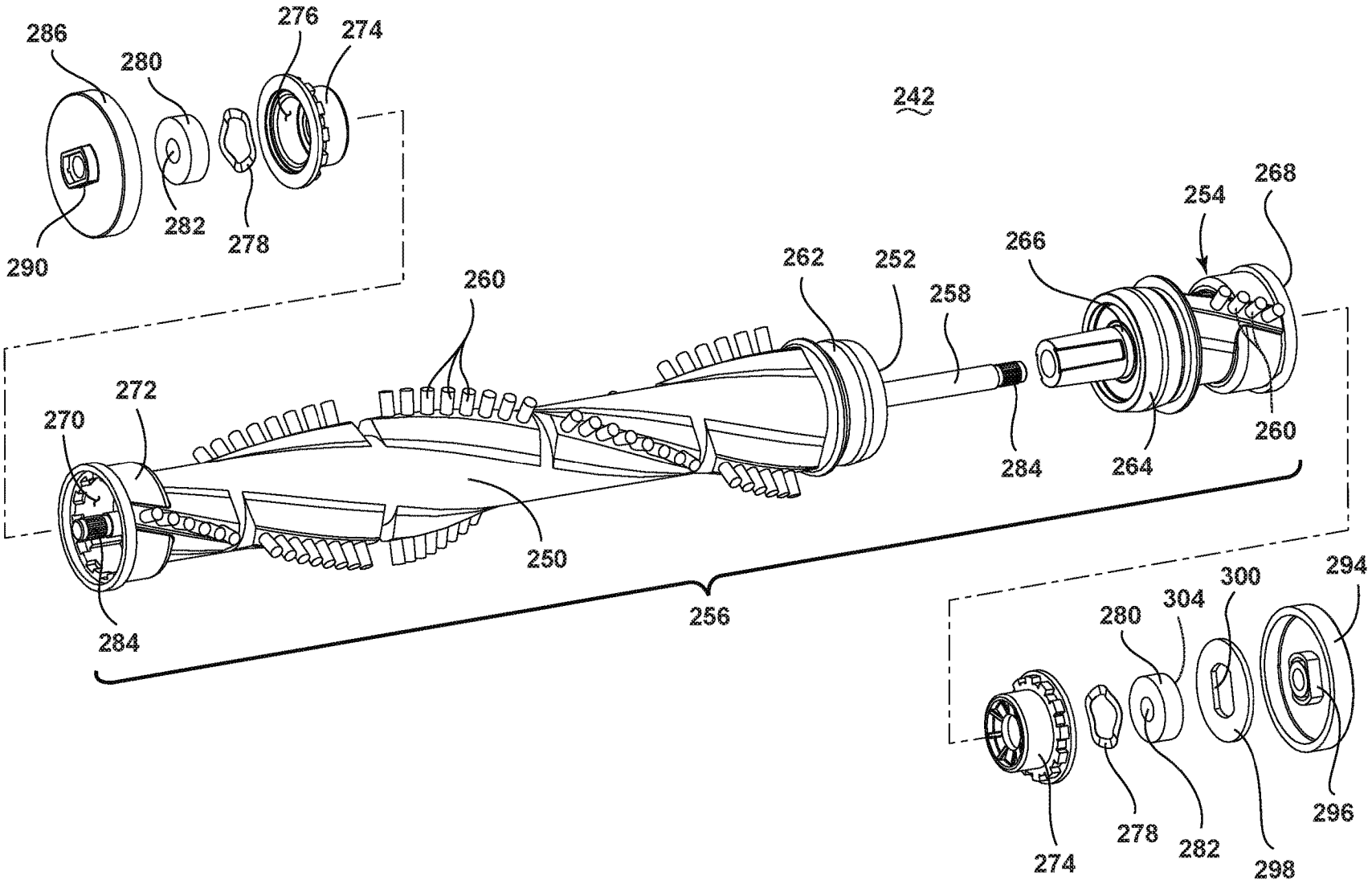
FIG. 14 is an exploded view of the agitator assembly from FIG. 13.

Referring to FIG. 14, which is an exploded view of the agitator assembly 242 from FIG. 13, the agitator assembly 242 can comprise a rotatable brushroll having a brush dowel 250 with a recessed end 252 that is configured to receive a dowel insert 254 therein. The brush dowel 250 and dowel insert 254 can be fixed together to form a dowel assembly 256 that is rotatably mounted about an agitator shaft 258 that lies along the longitudinal axis of the agitator assembly 242. A plurality of bristle tufts 260 protrude from the outer periphery of dowel assembly 256, for example, from both the brush dowel 250 and the dowel insert 254. A drive pulley 262 is formed near the recessed end 252 of the brush dowel 250. One end of the dowel insert 254 is stepped down to a reduced diameter to receive an idler pulley 264 and corresponding idler bearing 266 thereon. The dowel insert 254 can be fastened to the dowel 250 by a variety of known manufacturing processes, including adhesive, welding, press-fit or mechanical fasteners, for example. When the dowel insert 254 is fixed to the dowel 250, the idler pulley 264 is positioned adjacent to the fixed drive pulley 262 and can rotate freely relative to the dowel insert 254 and dowel 250, about the idler bearing 266.

The shaft 258 extends through the center of the dowel assembly 256 along the longitudinal axis of the agitator assembly 242. A first cavity 268 is provided in the outboard end of the dowel insert 254 and a second cavity 270 is provided in a second end 272 of the dowel 250, opposite the recessed end 252. Each cavity 268, 270 receives a substantially identical bearing assembly which includes a bearing holder 274 mounted within the cavity 268, 270. The bearing holder 274 includes a pocket 276 for receiving a wavy spring washer 278 and bearing 280 therein. The bearing 280 includes a central aperture 282, which is configured to be press fit onto the shaft 258, inboard from a stepped, knurled end 284 of the shaft 258.

Figure 15:
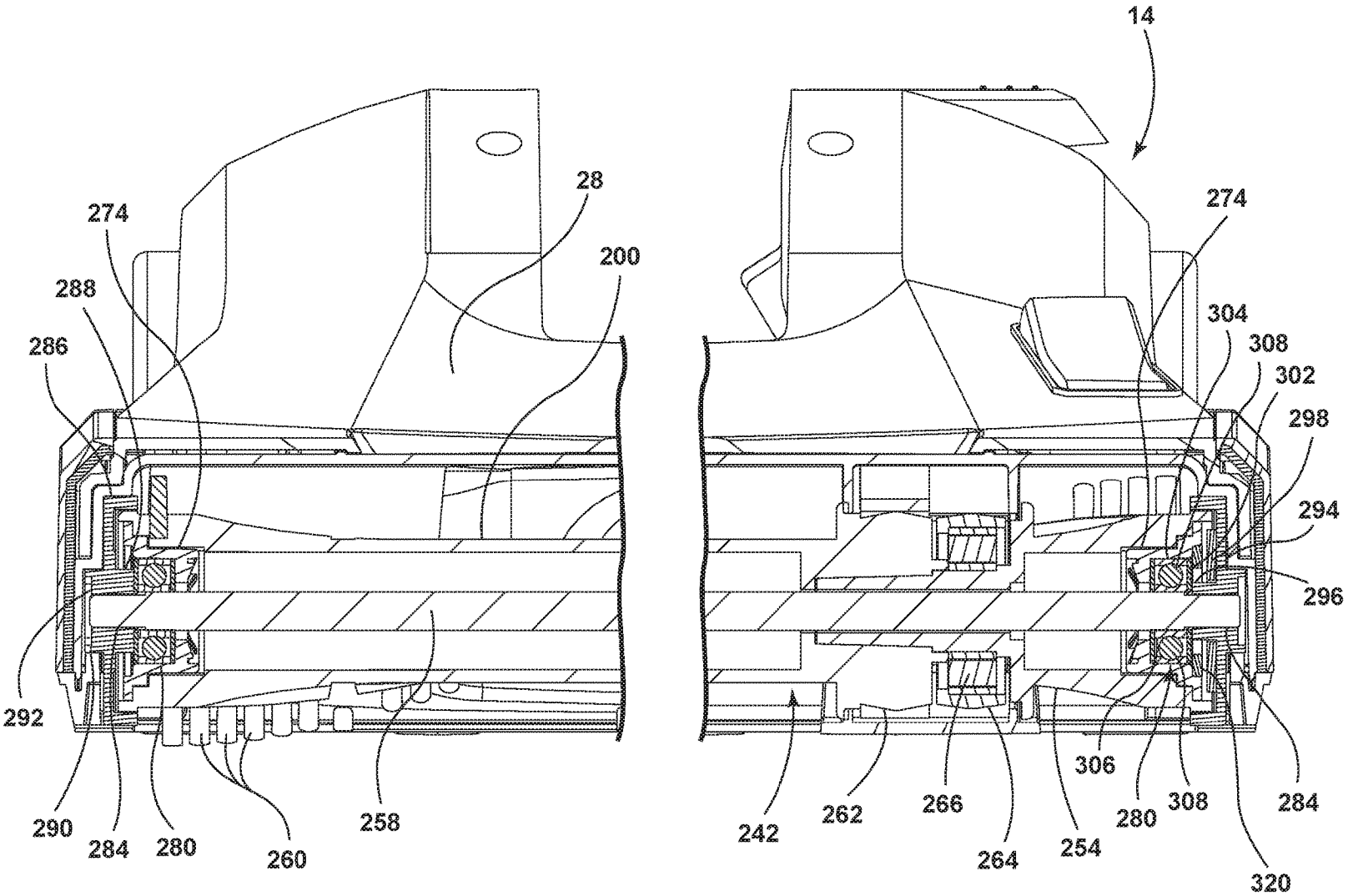
FIG. 15 is a sectional view taken through line XV-XV of the vacuum cleaner of FIG. 13, with a central portion of the foot assembly removed for clarity.

Referring additionally to FIG. 15, which is a sectional view taken through line XV-XV of the vacuum cleaner of FIG. 13, with a central portion of the foot assembly 14 removed for clarity, a first end cap 286 comprises an internal collar 288 that can be press fit onto the first stepped, knurled end 284 of the shaft 258 on the non-drive side of the agitator assembly 242 and further comprises an outer projection 290 that is received in a corresponding retention feature 292 within the housing 28. A second end cap 294 includes an internal collar defined by a keyed protrusion 296 that is adapted for mounting onto the stepped, knurled end 284 of the shaft 258 on the drive side of the agitator assembly 242. The second end cap 294 receives a substantially disk-shaped magnet 298 therein. The magnet can comprise a keyed aperture 300 that corresponds to the keyed protrusion 296 to prevent rotation of the magnet 298 relative to the end cap 294.

The illustrated bearing 280 includes an outer casing 302 which provides a housing for outer and inner races 304, 306 supporting internal rolling elements 308. The inner race 306 can have a fixed radial position on the shaft 258 with the outer race 304, rolling elements 308, and outer casing 302 rotating around the shaft 258. The bearing 280 adjacent to the magnet 298 may have one or more components made from a ferrous material. For example, the outer casing 302 can be made of a ferrous material. The outer race 304 can also be made of a ferrous material. The ferrous outer casing 302 and outer race 304 can be attracted by the magnetic force of the magnet 298. The magnet 298 can be positioned adjacent to the outer casing 302 of the bearing 280 when the second end cap 294 is press fit onto the shaft 258. The magnet 298 is adapted to attract the ferrous components of the bearing 280 and, more specifically, is adapted to apply a magnetic force on the moving parts, including the outer casing 302 and outer race 304 to inhibit rotation of the dowel assembly 256 as will be described hereinafter.

Figure 16:
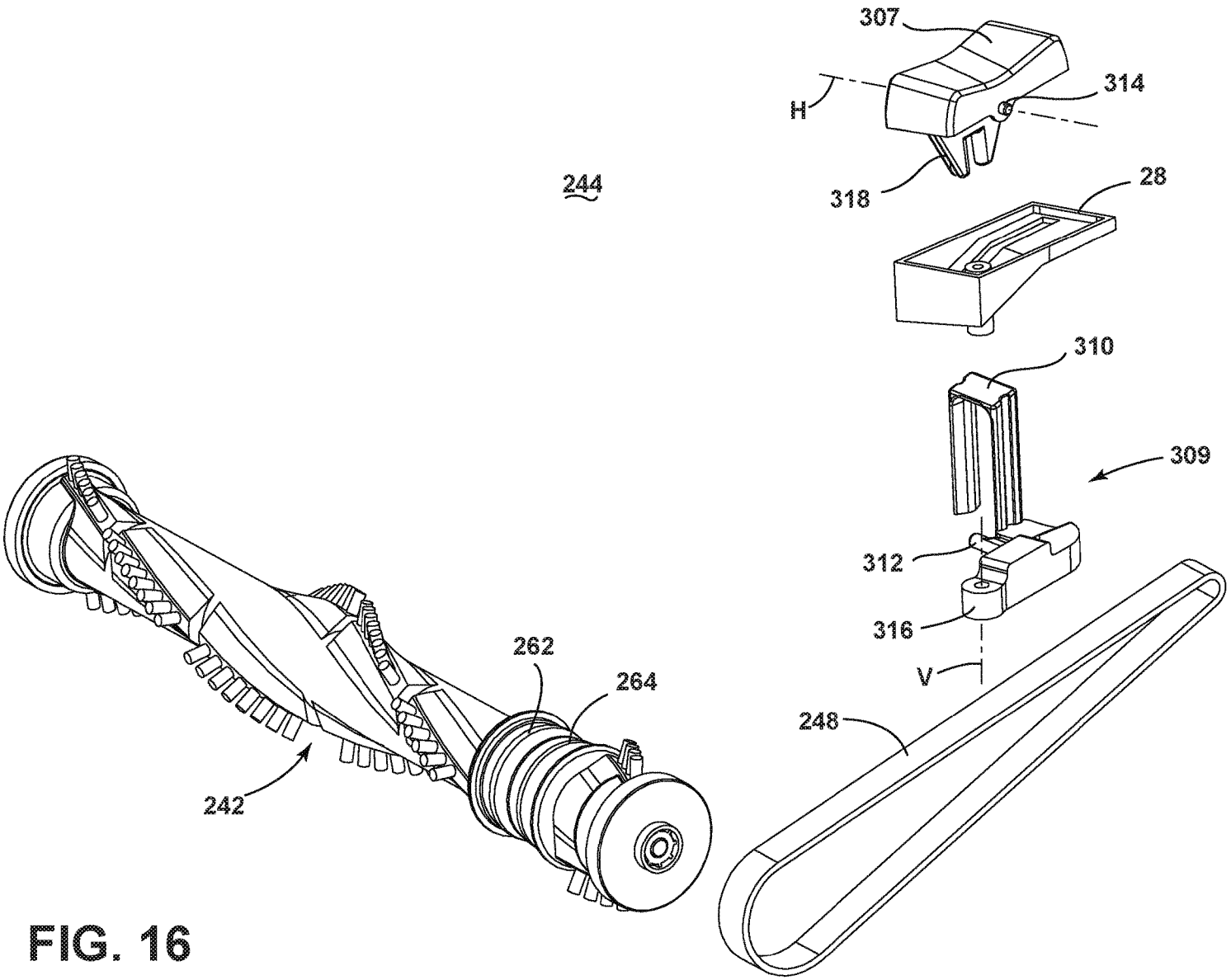
FIG. 16 is a partially-exploded view of the agitator assembly and the belt shifter assembly from FIG. 13.

Referring to FIG. 16, which is a partially-exploded view of the agitator assembly 242 and the belt shifter assembly 244, the belt shifter assembly 244 comprises a pedal 307 that is pivotally mounted to the top of the housing 28 along a horizontal axis "H" defined by a pivot shaft 314. The pedal 307 is operably connected to a belt yoke 309, which is pivotally mounted to the housing 28 about a vertical axis "V" defined by a pivot boss 316. The belt yoke 309 comprises a U-shaped portion 310 that partially surrounds the edges of the belt 248 and an arm 312 that is in register with an arm receiver 318 on a lower portion of the pedal 307. In use, when the belt yoke 309 is pivoted about the vertical axis "V", the U-shaped portion 310 contacts either outer edge of the belt 248 and translates the belt 248 laterally along the motor shaft 246, which shifts the opposite end of the belt 248 between the drive pulley 262 and the idler pulley 264, depending on whether a user desires to operate the vacuum cleaner 10 with or without rotation of the agitator assembly 242.

Figure 17:
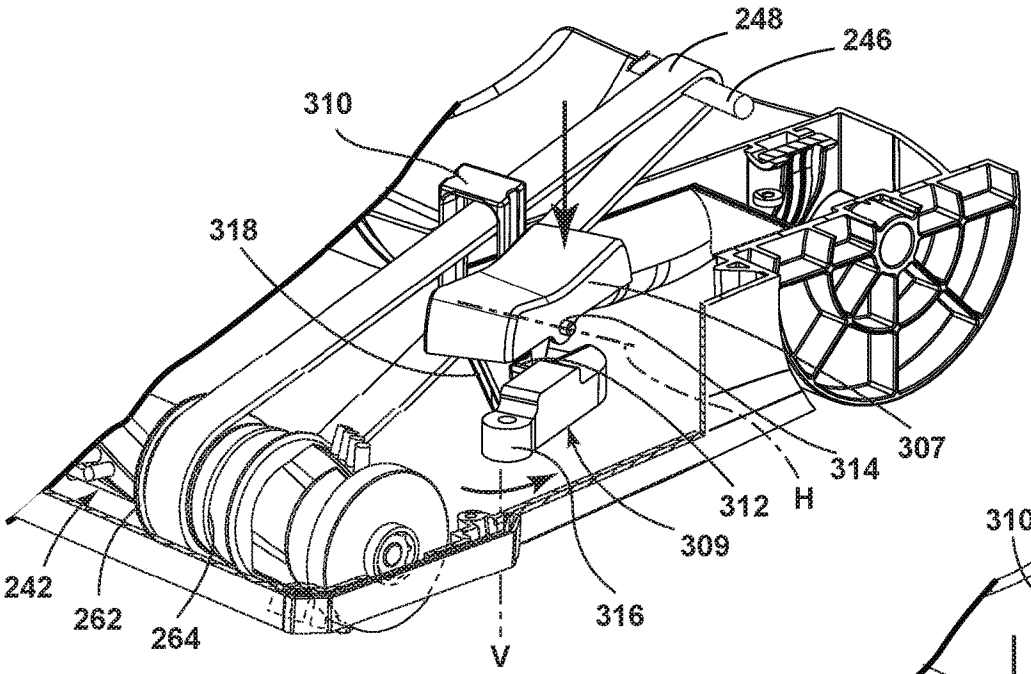
FIG. 17 is a perspective view of the belt shifter assembly, illustrating the operation of the belt shifter assembly to transmit rotation to the agitator assembly.
Figure 18:
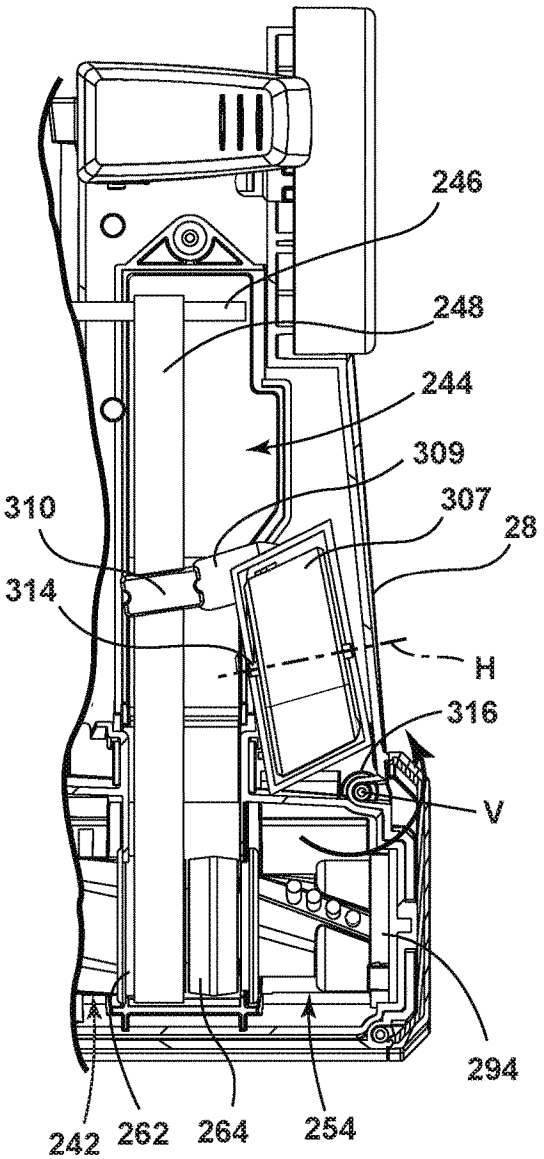
FIG. 18 is a top view of the belt shifter assembly, illustrating the operation of the belt shifter assembly to transmit rotation to the agitator assembly.

FIGS. 17-20 illustrate the operation of the belt shifter assembly 244. During use, as the pedal 307 is pivoted rearwardly about the horizontal axis "H", such as by depressing a rear end of the pedal 307 as shown in FIG. 17, the arm receiver 318 of the pedal 307 forces the arm 312 forwardly, which, in turn, pivots the belt yoke 309 about the vertical axis "V" such that the U-shaped portion 310 of the belt yoke 309 shifts the belt 248 onto the drive pulley 262 as shown in FIG. 18. Thus, rotational force is transmitted from the motor shaft 246 to the agitator assembly 242 via the belt 248 and drive pulley.

Figure 19:
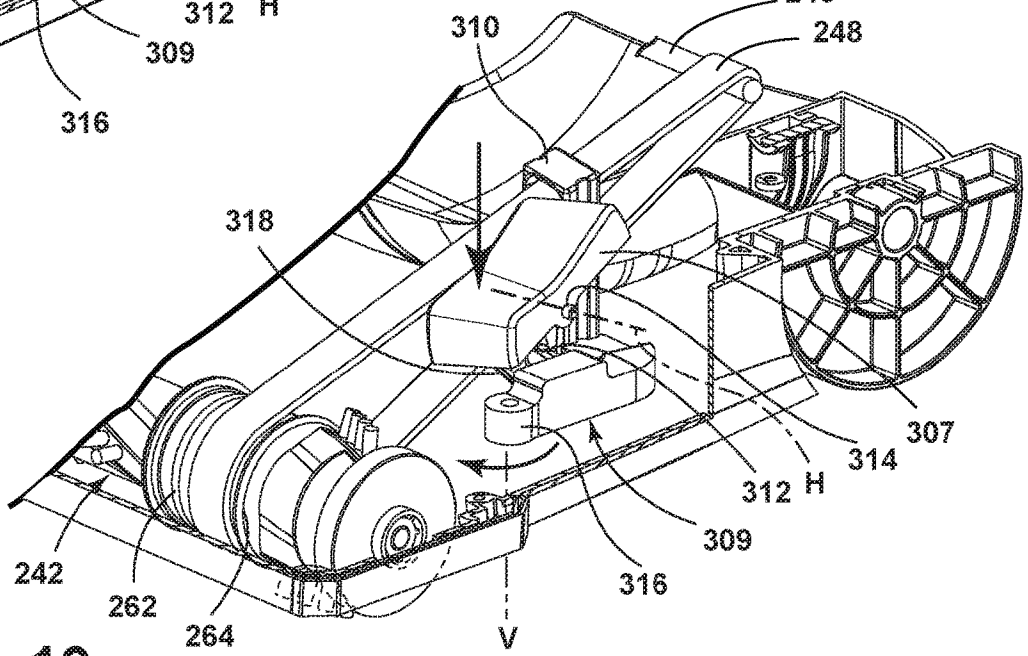
FIG. 19 is a perspective view of the belt shifter assembly, illustrating the operation of the belt shifter assembly to stop rotation of the agitator assembly.
Figure 20:
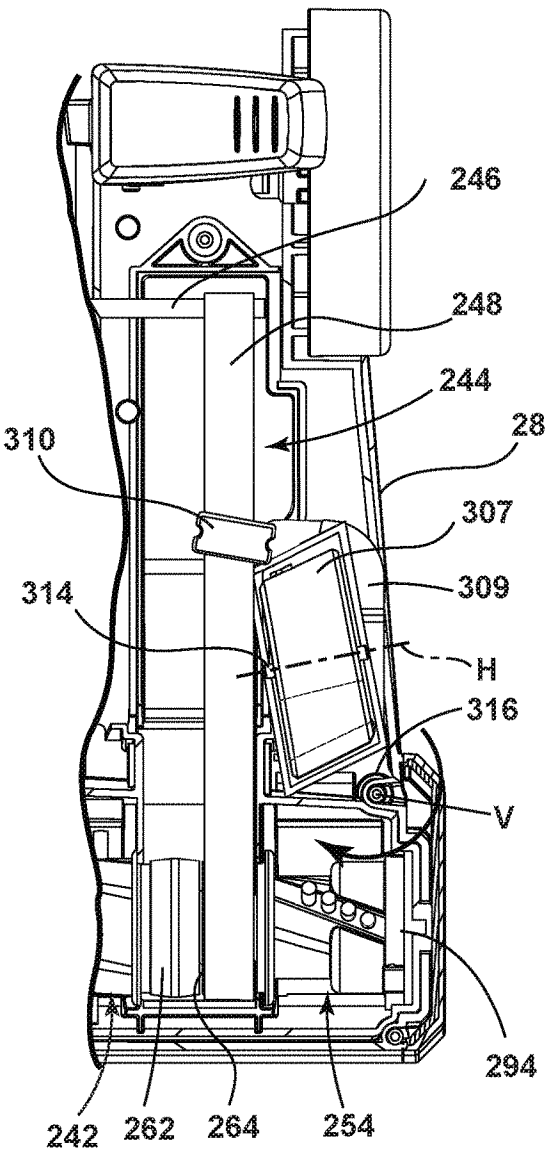
FIG. 20 is a top view of the belt shifter assembly, illustrating the operation of the belt shifter assembly to stop rotation of the agitator assembly.

As the pedal 307 is pivoted forwardly about the horizontal axis "H", such as by depressing a front end of the pedal 307 as shown in FIG. 19, the arm receiver 318 of the pedal 307 forces the arm 312 rearwardly, which, in turn, pivots the belt yoke 309 about the vertical axis "V" such that the U-shaped portion 310 of the belt yoke 309 shifts the belt 248 onto the idler pulley 264 as shown in FIG. 20. Thus, rotational force is transmitted from the motor shaft 246 to the idler pulley 264 via the belt 248.

Referring to FIG. 15, as previously described, during use, a user can selectively shift the belt 248 from the drive pulley 262 to the idler pulley 264 or vice versa to initiate or cease rotation of the agitator assembly 242. When the belt 248 is shifted from the rotating drive pulley 262 onto the stationary idler pulley 264 during operation or when the vacuum cleaner 10 is energized with the belt 248 on the idler pulley 264, friction within the idler bearing 266 can cause some undesirable rotational force to be transmitted to the dowel assembly 256. According to one aspect of the present disclosure, the magnet 298 within the second end cap 294 applies a magnetic force onto the bearing 280 adjacent to the second end cap 294 to inhibit rotation of the agitator assembly 242. The magnet 298 overcomes any residual rotational force transmitted to the dowel assembly 256 due to internal friction or momentum between the idler bearing 266 and the dowel assembly 256 as the belt 248 is shifted from the drive pulley 262 to the idler pulley 264. Thus, the magnet 298 inhibits undesirable rotation of the dowel assembly 256 when the belt 248 is shifted from the drive pulley 262 onto the idler pulley 264.

The magnetic anti-rotational force can be increased by increasing the surface area of the ferrous component(s) within the bearing holder 274 that are susceptible to magnetic force. For example, a ferrous disk 320 can be mounted on the face of the bearing holder 274, adjacent to the second end cap 294. The ferrous disk 320 can be keyed to corresponding features on the bearing holder 274 to prevent rotation of the disk 320 relative to the bearing holder 274 during operation. The disk 320 and bearing holder 274 can be adapted to rotate about the shaft 258 on the previously described bearings 280, together with the dowel assembly 256. The disk 320 provides a larger surface area compared to the area provided by the outer casing 302 and bearing races 304 and thus a larger anti-rotational magnetic force can be applied on the disk 320 by the magnet 298 to enhance the anti-rotation function of the magnet 298.

Figure 21:
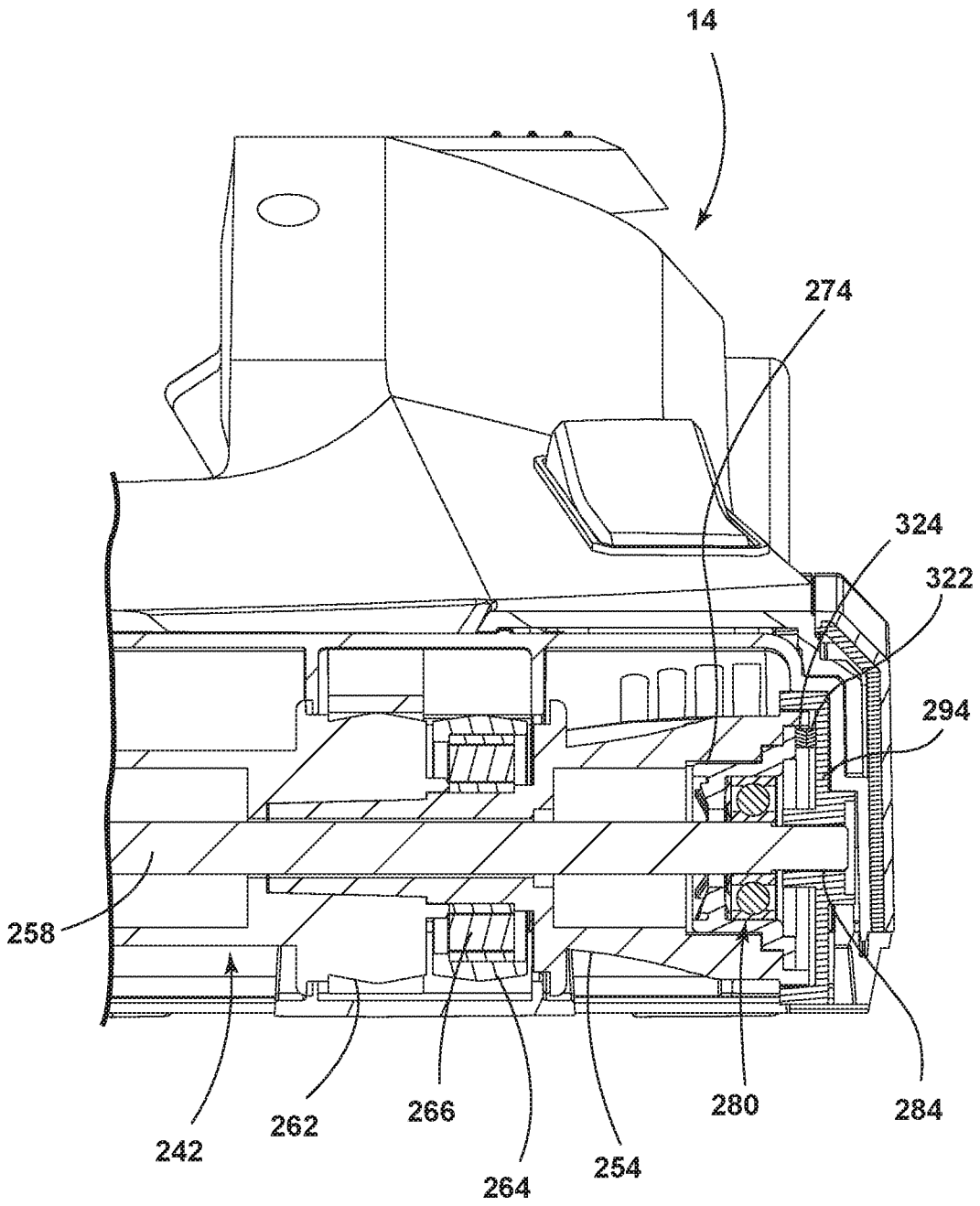
FIG. 21 is a partial sectional view of a vacuum cleaner according to a third aspect of the present disclosure, with a portion of vacuum cleaner sectioned through the agitator assembly so that the internal components of the agitator assembly are visible.

FIG. 21 is a partial sectional view of a vacuum cleaner 10 according to a third aspect of the present disclosure, with a portion of vacuum cleaner 10 cut away to show the agitator assembly 242. In FIG. 20, the foot assembly is sectioned through the agitator assembly 242 so that the internal components of the agitator assembly 242 are visible. The vacuum cleaner 10 can be substantially similar to the vacuum cleaner 10 of the second aspect shown in FIG. 13, with the exception that the magnetic rotation inhibitor for the agitator assembly 242 is modified. In the third aspect, a first magnet 322 can be mounted near the periphery of the inner face of the second end cap 294. A second magnet 324 can be mounted within the outer face of the bearing holder 274, adjacent to the second end cap 294. The second magnet 324 can be oriented so the magnetic pole opposes the magnetic pole of the first magnet 322, such that the first and second magnets 322, 324 are magnetically attracted and thus generate an anti-rotational force to inhibit residual rotational force that is applied on the dowel assembly 256 due to internal friction or momentum between the idler bearing 266 and the dowel assembly 256 when the belt 248 is shifted from the drive pulley 262 to the idler pulley 264 as previously described.

While the aspects of the present disclosure have been specifically described in connection with certain specific aspects thereof, it is to be understood that this is by way of illustration and not of limitation. For example, while the cyclone module assemblies illustrated herein are shown having two concentric stages of separation, it is understood that the louvered exhaust grill could be applied to a single stage separator, multiple parallel first and/or second stage, or additional downstream separators, or other types of cyclone separators. Reasonable variation and modification are possible with the scope of the foregoing disclosure and drawings without departing from the spirit of the present disclosure which, is defined in the appended claims. Hence, specific dimensions and other physical characteristics relating to the aspects disclosed herein are not to be considered as limiting, unless the claims expressly state otherwise.

What is claimed is:

1. A vacuum cleaner comprising:

a suction inlet for working air;

a cyclone separator having an air inlet for the working air in fluid communication with the suction inlet, and an air outlet for the working air at an upper end thereof;

a collection chamber below the cyclone separator and having a side wall;

a pre-motor filter downstream from the cyclone separator and above the upper end thereof, the pre-motor filter positioned in a pre-motor filter housing and comprising an upstream surface and a downstream surface, wherein the upstream surface is a first portion of the pre-motor filter exposed to the working air during operation of the vacuum cleaner;

a door pivotally mounted to the side wall of the collection chamber by a hinge and forming a bottom wall of the collection chamber when in a closed position;

a first latch opposite the hinge and selectively maintaining the door in the closed position;

a handle grip that can be gripped by a user to facilitate lifting and carrying the entire vacuum cleaner;

an openable cover above the pre-motor filter and having an upper surface that forms an outer surface of the vacuum cleaner and having a bottom edge, wherein the openable cover provides access to the upstream surface of the pre-motor filter when open and wherein the forwardmost portion of the openable cover is forward of the handle grip;

a second latch on the openable cover to secure the openable cover in place;

a suction source positioned downstream of the pre-motor filter; and an exhaust outlet for the working air downstream of the suction source; and wherein the upper surface of the openable cover is angled forwardly at an incline, with a forwardmost portion of the openable cover being lower than a rearmost portion of the openable cover.

2. The vacuum cleaner of claim 1 wherein the pre-motor filter comprises a peripheral surface joining the upstream surface and the downstream surface, wherein a thickness of the pre-motor filter defined between the upstream and downstream surfaces is less than a width of the pre-motor filter defined by the peripheral surface.

3. The vacuum cleaner of claim 1 wherein a portion of the pre-motor filter extends forwardly and rearwardly relative to the air outlet of the cyclone separator.

4. The vacuum cleaner of claim 1 wherein the pre-motor filter housing comprises a grill on the downstream surface of the pre-motor filter and defining a plurality of filter outlets which allow working air to pass through the pre-motor filter.

5. The vacuum cleaner of claim 1, further comprising a first seal provided between the door and the side wall of the collection chamber to seal an interface therebetween when the door is closed, and a second seal associated with the pre-motor filter housing for sealing the pre-motor filter housing when the openable cover is closed.

6. The vacuum cleaner of claim 1 wherein the first latch is opposite the second latch.

7. The vacuum cleaner of claim 1 wherein the second latch is flush with the openable cover.

8. The vacuum cleaner of claim 1 wherein the second latch is spring-biased to a locked position.

9. The vacuum cleaner of claim 1 wherein the handle grip is adjacent the pre-motor filter housing, with a gap defined by the handle grip being between the handle grip and the pre-motor filter housing.

10. The vacuum cleaner of claim 1 wherein a rotational axis of the hinge of the door is orthogonal to the handle grip.

11. The vacuum cleaner of claim 1 wherein the cyclone separator comprises a side wall and a separator plate, and wherein a debris outlet from the cyclone separator is defined by the separator plate and the side wall of the cyclone separator.

12. The vacuum cleaner of claim 1 wherein the collection chamber is wider than the cyclone separator.

13. The vacuum cleaner of claim 1, further comprising a filter positioned within the cyclone separator, downstream of the air inlet and upstream of the pre-motor filter.

14. The vacuum cleaner of claim 1 wherein the suction source comprises a fan/motor assembly, and the fan/motor assembly is below the air inlet to the cyclone separator.

15. The vacuum cleaner of claim 14 wherein the fan/motor assembly is oriented transversely to a central axis of the cyclone separator.

16. The vacuum cleaner of claim 1 wherein the openable cover further comprises a depending side surface, the depending side surface defining the bottom edge.

17. The vacuum cleaner of claim 16 wherein a forwardmost portion of the depending side surface is lower than a rearmost portion of the depending side surface.

18. The vacuum cleaner of claim 17 wherein the bottom edge of the openable cover is angled forwardly at an incline, with a forwardmost portion of the bottom edge being lower than a rearmost portion of the bottom edge.

19. A vacuum cleaner comprising:

a suction inlet for working air;

a cyclone separator having an air inlet for the working air in fluid communication with the suction inlet, and an air outlet for the working air at an upper end thereof;

a collection chamber below the cyclone separator and having a side wall;

a pre-motor filter downstream from the cyclone separator and above the upper end thereof, the pre-motor filter positioned in a pre-motor filter housing and comprising an upstream surface and a downstream surface, wherein the upstream surface is a first portion of the pre-motor filter exposed to the working air during operation of the vacuum cleaner wherein the pre-motor filter comprises a peripheral surface joining the upstream surface and the downstream surface, wherein a thickness of the pre-motor filter defined between the upstream and downstream surfaces is less than a width of the pre-motor filter defined by the peripheral surface;

a door pivotally mounted to the side wall of the collection chamber by a hinge and forming a bottom wall of the collection chamber when in a closed position;

a first latch opposite the hinge and selectively maintaining the door in the closed position;

an openable cover above the pre-motor filter and having an upper surface that forms an outer surface of the vacuum cleaner and having a bottom edge, wherein the openable cover provides access to the upstream surface of the pre-motor filter when open;

a second latch on the openable cover to secure the openable cover in place;

a suction source positioned downstream of the pre-motor filter; and an exhaust outlet for the working air downstream of the suction source; and wherein the upper surface of the openable cover is angled forwardly at an incline, with a forwardmost portion of the openable cover being lower than a rearmost portion of the openable cover.

20. A vacuum cleaner comprising:

a suction inlet for working air;

a cyclone separator having an air inlet for the working air in fluid communication with the suction inlet, and an air outlet for the working air at an upper end thereof;

a collection chamber below the cyclone separator and having a side wall;

a pre-motor filter downstream from the cyclone separator and above the upper end thereof, the pre-motor filter positioned in a pre-motor filter housing and comprising an upstream surface and a downstream surface, wherein the upstream surface is a first portion of the pre-motor filter exposed to the working air during operation of the vacuum cleaner;

a door pivotally mounted to the side wall of the collection chamber by a hinge and forming a bottom wall of the collection chamber when in a closed position;

a first latch opposite the hinge and selectively maintaining the door in the closed position;

an openable cover above the pre-motor filter and having an upper surface that forms an outer surface of the vacuum cleaner and having a bottom edge, wherein the openable cover provides access to the upstream surface of the pre-motor filter when open;

a second latch on the openable cover to secure the openable cover in place;

a suction source positioned downstream of the pre-motor filter, wherein the suction source comprises a fan/motor assembly, and the fan/motor assembly is below the air inlet to the cyclone separator and the fan/motor assembly is oriented transversely to a central axis of the cyclone separator; and an exhaust outlet for the working air downstream of the suction source; and wherein the upper surface of the openable cover is angled forwardly at an incline, with a forwardmost portion of the openable cover being lower than a rearmost portion of the openable cover.

* * * * *